US005262824A

United States Patent [19]

Morita et al.

[11] Patent Number: 5,262,824

[45] Date of Patent: Nov. 16, 1993

[54] IMAGE FORMIMG APPARATUS WITH AUTOMATIC PROCESS CARTRIDGE DISPLACEMENT FOR MAINTENANCE

[75] Inventors: Shizuo Morita; Masakazu Fukuchi; Satoshi Haneda; Hisao Satoh; Tadayoshi Ikeda, all of Hachioji, Japan

[73] Assignee: Konica Corporation, Tokyo, Japan

[21] Appl. No.: 734,639

[22] Filed: Jul. 23, 1991

[30] Foreign Application Priority Data

| | | | |
|---|---|---|---|
| Jul. 26, 1990 | [JP] | Japan | 2-200794 |
| Jul. 26, 1990 | [JP] | Japan | 2-200797 |
| Oct. 11, 1990 | [JP] | Japan | 2-272544 |
| Oct. 12, 1990 | [JP] | Japan | 2-274021 |

[51] Int. Cl.[5] ..... G03G 15/00

[52] U.S. Cl. ..... 355/206; 355/200; 355/211

[58] Field of Search ..... 355/200, 210, 211, 212, 355/206, 207

[56] References Cited

U.S. PATENT DOCUMENTS

| | | | |
|---|---|---|---|
| 5,041,872 | 8/1991 | Nukaya et al. | 355/200 |
| 5,047,803 | 9/1991 | Kanoto | 355/211 |

FOREIGN PATENT DOCUMENTS

| | | | |
|---|---|---|---|
| 0331324 | 9/1989 | European Pat. Off. . | |
| 0407183 | 1/1991 | European Pat. Off. . | |
| 0468749 | 1/1992 | European Pat. Off. . | |
| 0468751 | 1/1992 | European Pat. Off. . | |
| 0468752 | 1/1992 | European Pat. Off. . | |
| 1-131577 | 5/1989 | Japan | 355/207 |
| 2-230165 | 9/1990 | Japan | 355/211 |

OTHER PUBLICATIONS

Patent Abstracts of Japan; vol. 10, No. 64 (P-436); Mar. 1986 & JP-A-60 205 563 (Ricoh K.K.) Oct. 17, 1985.

Patent Abstracts of Japan; vol. 13, No. 448 (P-942); Oct. 1989 & JP-A-01 172 849 (Canon K.K.) Jul. 7, 1989.

Patent Abstracts of Japan; vol. 13, No. 438 (P-939); Oct. 1989 & JP-A-01 167 765 (Canon K.K.) Jul. 3, 1989.

Patent Abstracts of Japan; vol. 13, No. 50 (P-823); Feb. 1989 & JP-A-63 244 058 (Canon) Oct. 11, 1988.

*Primary Examiner*—Joan H. Pendegrass

*Attorney, Agent, or Firm*—Frishauf, Holtz, Goodman & Woodward

[57] ABSTRACT

An image forming apparatus provided with a process cartridge which contains at least an image carrying body fixed therein. The process cartridge is slidably provided to a main frame of the apparatus and is adapted to occupy two positions of a first position to perform the image forming and a second position suitable for maintenance and pulling out of the process cartridge for the main body. The process cartridge is drived automatically to the second position in each case of jam occurence in copy paper conveyance and maintenance.

18 Claims, 18 Drawing Sheets

IMAGE FORMIMG APPARATUS WITH AUTOMATIC PROCESS CARTRIDGE DISPLACEMENT FOR MAINTENANCE

BACKGROUND OF THE INVENTION

The present invention relates to an image forming apparatus for obtaining image in an electrophotographic way for use as a printer, a copying machine, a facsimile machine, or similar machines.

There have been many prior disclosures about the electrophotographic way to reproduce color images. In the Japanese Patent Application Laid-Open No. 61-100770, for example, a photoreceptor drum of image carrier has a latent image formed and developed corresponding to number of decomposed colors of an original picture. The image is transferred to a transfer drum every time it is developed to form multi-color image on the transfer drum. After this, it is transferred onto recording paper to obtain color copy. However, the apparatus of the method described has the disadvantage that it is needed to have a transfer drum which is large enough to be able to whole page of image on a surface thereof in addition on the photoreceptor drum. The apparatus is unavoidably made to a large size and complicated in the construction.

As another example, in the apparatus disclosed in the Japanese Patent Application Laid-Open No. 61-149972, a photoreceptor drum has a latent image formed and developed corresponding to number decomposed colors of an original picture. The image is transferred to transfer material every time development to reproduce multi-color copy. However, the apparatus described above have the disadvantage that it is hard to accurately register a plurality of color images to obtain quality color copy.

As another example of the conventional apparatuses, registration of color toner images are registered on a photoreceptor drum by repeating forming of latent images corresponding to number of decomposed colors of an original picture on the photoreceptor drum and developing them with color toners. After this, the registered image is transferred to obtain a color image. This basic process for forming multi-color image is disclosed in, for example, the Japanese Patent Application Laid-Open Nos. 60-75850, 60-76766, 60-95456, 60-95458, and 60-158475.

In the multi-color image forming apparatus in which the images are registered to obtain the color image, there are provided around the photoreceptor drum a plurality of developing sections containing toners of different colors. The photoreceptor drum is ordinarily turned a plurality of times to develop the latent images on the photoreceptor drum to reproduce the color image.

On the other hand, for analog copying machines of monochrome and color type using an electrophotographic method and image forming apparatuses, such as copying machine and printer, using a semiconductor laser or LED scanning system, it has been proposed to assemble parts of the image forming arrangements in a cartridge for replacing or supplying consumable photoreceptors, developing carrier, cleaning members, and developing toner. The cartridge containing the major image forming arrangements can be taken out of the apparatus body for maintenance or replacement. There also have been proposed many constructions that the feed path for the transfer material having image formed by the image forming arrangements can be made to open for easy removal of the transfer material upon jamming.

As a typical example of the constructions mentioned above, the Japanese Patent Publication No. 58-54392 proposes that a photoreceptor drum, a developing arrangement, and a cleaner are together mounted on a supporting member. They can be pulled out of the apparatus body for easy maintenance and replacement.

The Japanese Patent Application Laid-Open No. 57-154255 has proposed that a cartridge having major image forming arrangements integrated together is disposable. The Japanese Patent Application Laid-Open No. 59-147366, which also uses a similar disposable cartridge, has disclosed a printer in which a semiconductor laser is used to make exposure, scanning, and writing of dots to form latent image on a photoreceptor drum.

Also, these laid-opens have disclosed that an upper casing of a dividable structure can be opened to make the transfer material feed path clear for taking the transfer material out upon jamming. The Laid-Open No. 57-154255 has a disposable process cartridge provided on an upper casing of a two-dividable structure so that it can be replaced for good workability of the cartridge and easy clearing of jamming.

The Japanese Patent Application Laid-Open No. 58-1161 has disclosed a two-dividable structure in chief view of easy replacement of process cartridges including a supply toner cartridge and a cleaning cartridge for collected toner. In particular, the process cartridges are provided on a lower casing for high maintainability.

The Japanese Patent Application Laid-Open Nos. 63-244058, 63-244059, 63-244064, and 1-179168 have proposed that the above mentioned structures are made vertical. These aim at unidirectional manipulations and easy clearing of jamming.

However, there has not been proposed a compact printer having a replaceable process cartridge comprising a developing arrangement and an image carrier which can be easily loaded in or taken out of the apparatus body, and is free of uneasy leakage and spilling of toner or developing agent from the developing arrangement upon insertion in or removal from the apparatus body or upon clearing the transfer material of jamming.

The Japanese Patent Application Laid-Open No. 58-190961 has proposed a printer of two-dividable structure that a process cartridge provided on an upper casing can be always kept horizontal not to spill waste toner when it is opened. Although loading of the cartridge and clearing of jamming can be made easily, it does not solve such problems as leakage and spilling of the toner upon loading the cartridge, clearing of jamming, and maintenance and replacement of them.

There have been other disclosures in the Japanese Patent Application Laid-Open No. 58-72159 in which a disposable cartridge is provided on an upper casing of the two-dividable structure mentioned above for easy clearing of jamming and in the Japanese Patent Application Laid-Open No. 58-1161 in which a process cartridge having a developing, cleaning, and photoreceptor arrangements is provided on a lower casing for easy supply and replacement of collected toner, and is brought upward upon clearing of jamming. In these prior arts, workability in replacement of the process cartridge contradicts easiness in clearing of jamming. Each of these process cartridges has the developing section and the cleaning section on its bottom. These sections face a transfer electrode with a sheet feed path put therebetween. The toner spills out of the developing arrangement and the cleaning arrangement upon replacement of the process cartridge or by external vibration or impacts to the apparatus body even if the cartridge is strictly sealed. This causes contamination in the apparatus and to the transfer paper.

The Japanese Utility Model Application Laid-Open No. 63-194357 has disclosed a printer having a process cartridge built in it and having a flat sheet feed path formed on its upper portion. However, it is limited in the sheet feed path from a transfer material separation section of a photoreceptor drum to a fixing section, or it does not solve a problem in the sheet feed section. The printer also is disadvantageous in that it is hard to clear jams upon division of the apparatus into two, is not compact as a whole due to a stack sheet feed construction of up-stand type, and has a limited opening of an upper casing upon division into two. That is, the printer is not always convenient for users.

In turn, there have been proposed many color image forming bodies, for example, by the present applicant in the Japanese Patent Application Laid-Open No. 64-192874. They, as described previously, includes a photoreceptor drum having a photoconductive substance coated or evaporated on surface of a drum and a belt-like image forming body having the photoconductive substance coated on or applied to a flexible belt. The belt-like image forming body (hereinafter also referred to as the photoreceptor belt) is determined in shape by putting it between revolving rollers including a drive roller. This is effective for making the color image forming apparatus compact with effective use of space. Also, it is desirable in that the photoreceptor belt can be run along with a small curvature so that the transfer material can be separated by making use of the curvature with use of a revolving roller of small diameter. This prevents the transfer material from being not separated.

In the color image forming apparatus using such a photoreceptor belt, image forming arrangements, including a charging arrangement, an image exposure arrangement, a plurality of developing sections, and a cleaning arrangement, are provided to face an outside surface of the photoreceptor belt, particularly a lower part of the outside surface. The image forming arrangements are assembled in a process cartridge together with the photoreceptor belt as an independent unit so that the cartridge can be loaded into or taken out of the apparatus body as necessary.

The transfer material having the color toner image transferred onto it can be discharged onto a discharge tray provided on a top of the apparatus with its copied side down. This makes the apparatus installation area narrower.

Recently, the Japanese Patent Application Laid-Open Nos. 64-40850 and 63-244059 mentioned above have proposed use of a compact cartridge to solve such problems as sheet feed, clearing of jamming. They also make unidirectional manipulation possible.

The Japanese Patent Application Laid-Open No. 63-85763 has disclosed a control concept for indications upon consumption of the toner in the process cartridge and the end of service life of the photoreceptor.

However, there have not been proposed a compact, easy-to-use image forming apparatus yet which meets all the conditions that jamming can be easily cleared, the toner cannot be spilled upon operation and manipulation of the cartridge, it can be easily replaced, and any of the manipulations can be made on the front of the apparatus unidirectionally.

Also, the Japanese Patent Application Laid-Open No. 61-279870 has proposed another image forming apparatus in which consumption articles and materials can be easily handled and treated and limitation of working space can be minimized by making a loading direction of a transfer material coincide with a loading and unloading direction of a process cartridge provided on an upper casing.

However, the apparatus mentioned in the Japanese Patent Application Laid-Open No. 61-279870 have the disadvantage that the operator himself has to move the movable sections to clear the sheet feed route of the transfer material, thereby making the working room. This is troublesome work. The working room obtained for clearing of jamming is too narrow to easily insert a hand into it to remove the jamming paper. To release the sheet feed route, he or she had to search for a position where the jamming paper is. If the sheet feed route is complicated, he or she had to move a plurality of movable portions at a time to release a plurality of sheet feed routes. He or she was not only confused in shooting the jamming position for a long time, but also might be involved in erroneous manipulations, resulting in some troubles.

The conventional image forming apparatuses have the disadvantage in the workability that as they were ordinarily leveled at around a waste of the operator, he or she had to sit down on his or her kneels or bend his or her body not only to see, but also to clear of the jamming paper.

In any way, as the conventional apparatuses caused the operator himself or herself to move the movable sections to release the sheet feed route, they were not only disadvantageous in the workability, but also might injure him or her or the image carrier if his or her hand had to force or put into narrow spaces.

In order to replace the process cartridge or cassette of the conventional apparatuses, the operator had to pull it out of the apparatus body to a great extent. This work was not only very troublesome, but also needed for him or her to have a mighty force to bring up the heavy process cartridge or cassette which might be in contact with the sheet feed roller or to erroneously drop it down.

In short, the conventional apparatuses are disadvantageous in the simplicity of work and safety when the jamming paper is to be removed or the process cartridge or cassette has to be replaced.

SUMMARY OF THE INVENTION

In view of the foregoing, it is an object of the present invention to provide an improved image forming apparatus which provides wider working space for clearing of jamming paper, allows an operator to easily replace a process cartridge, and is superior in the maintainability. More particularly, it is an object of the present invention to provide an improved image forming apparatus for which an operator can easily make replacement of consumption articles and materials, maintenance and replacement of process resources, and clearing of jamming on one side of the apparatus.

Briefly, the foregoing object is accomplished in accordance with aspects of the present invention by an improved image forming apparatus, characterized in that a process cartridge, including an image carrier, slidably provided on an integrated frame for the apparatus body is released to a certain amount horizontally or obliquely upward upon occurrence of feed trouble of transfer material as interlocked with the occurrence.

Also, the foregoing object is accomplished in accordance with aspects of the present invention by an improved image forming apparatus having the process cartridge, including at least the replaceable image carrier, built in it, characterized in that a transfer material feed path of the image forming apparatus has a jamming detection arrangement, and that if the jamming detection arrangement detects jamming, the process cartridge is moved from a first position where image forming can be made to a second position where it can be loaded or unloaded and jamming can be cleared, and that if the jamming detection arrangement detects release of jamming, the process cartridge is moved from the second position to the first position.

Further, the foregoing object is accomplished in accordance with aspects of the present invention by an improved image forming apparatus, characterized in that the process cartridge, including the image carrier, slidably provided on rails of guide members turnable from a horizontal position to a predetermined angle on the integrated frame for the apparatus body is turned horizontal together with the guide rail as interlocked with a signal generated upon occurrence of feed trouble of transfer material or preventive inspection of the cartridge, and is released to a certain amount horizontally, and that the release is interlocked with opening of an exterior cover provided in the same direction as the release.

Furthermore, the foregoing object is accomplished in accordance with aspects of the present invention by an improved image forming apparatus, characterized in that the opened exterior cover serves as a guide arrangement for the process cartridge.

BRIEF DESCRIPTION OF THE DRAWINGS

Other objects and advantages of the present invention will further become apparent thereinafter and in the drawings in which.

DETAILED DESCRIPTION OF THE PREFERRED EMBODIMENT

The color image forming apparatus of the present invention is illustrated in an embodiment in further detail by reference to the accompanying drawings FIGS. 1 through 7.

Figure 1:
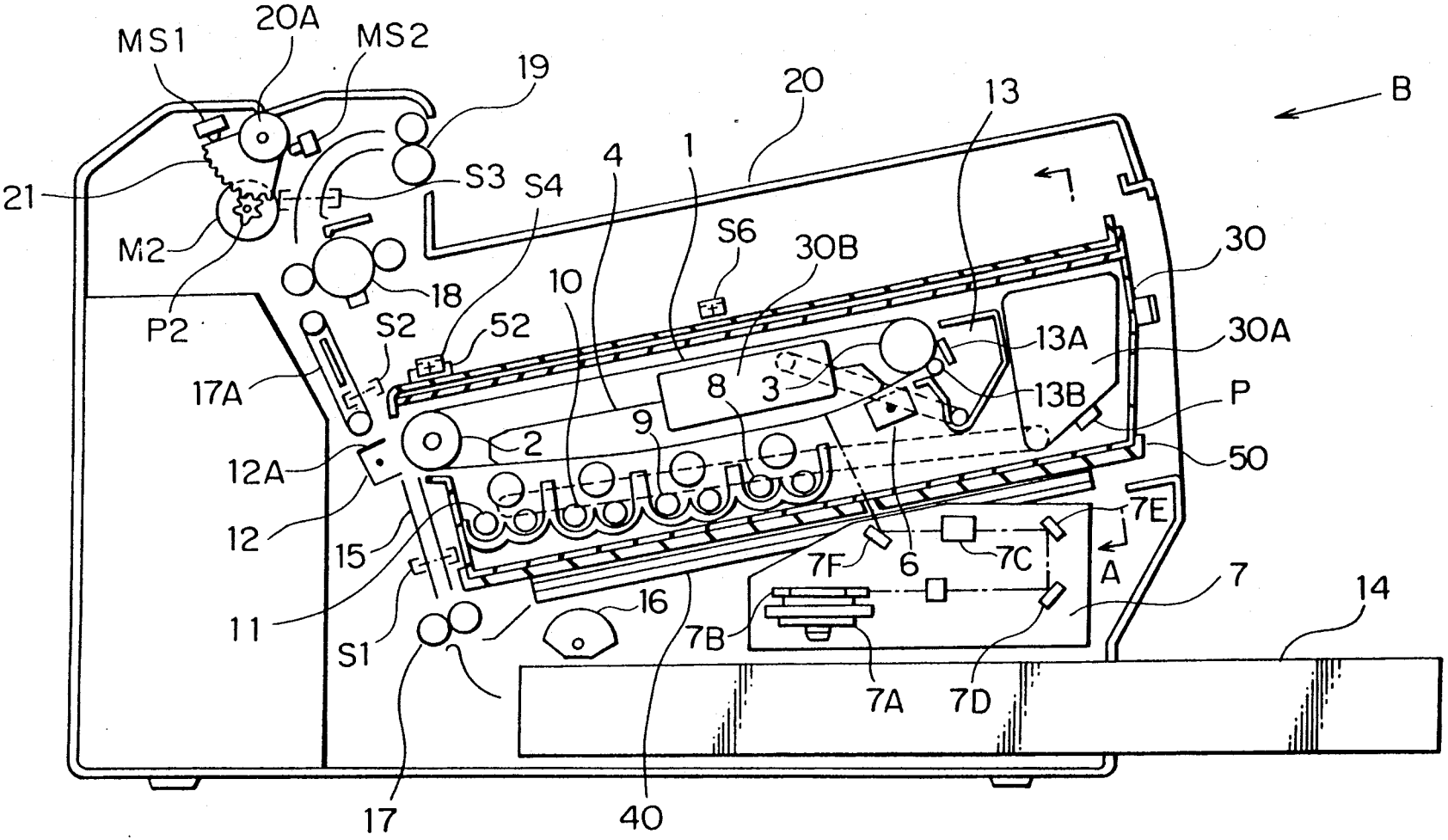
FIGS. 1, 2, and 7 are cross sectional side views for an image forming apparatus according to the present invention.

In FIG. 1 is shown a flexible photoreceptor belt 1 of belt-like image carrier which is provided between revolving rollers 2 and 3, and is driven clockwise by the revolving roller 2.

A guide member 4 is held on the apparatus body so as to contact an inside of the photoreceptor belt 1. The photoreceptor belt 1 is tensed as pressed up by a tension roller 5 so that the inside can be slid on the guide member 4.

Thus, the photoreceptor on the outside of the photoreceptor belt 1 can be always kept in a certain relationship with respect to the guide member 4 while it is carried. This allows stable image forming.

There are provided image forming arrangements, including a scotron charger 6 for charging, a laser writing system unit 7 for image exposure, and developing sections 8 through 11 comprising a plurality of developing sections containing developing agents of particular colors, facing the outside of the photoreceptor belt 1.

The laser writing system unit 7 can use an optical system having an light emitting source and a convergent light transmission arrangement integrated together in place of an optical system shown in the figure.

The developing sections 8 through 11 contain the developing agents of, for example, yellow, magenta, cyan, and black, respectively, for each of which developing sleeves are arranged to provide predetermined gaps to develop latent images on the photoreceptor belt 1 in a non-contact developing method. The non-contact developing method, unlike the contact developing method, is advantageous not in preventing the photoreceptor belt 1 from moving.

There are arranged around the outside of the photoreceptor belt 1 a transfer arrangement 12, a discharge bar 12A, and a cleaning arrangement 13. A blade 13A and a toner feed roller 13B of the cleaning arrangement 13 are kept separated from the outside of the photoreceptor belt 1, but are brought contact with the outside only during cleaning after image transfer as shown in the figure.

The following describes processes of color image forming in the color image forming apparatus of the present invention.

First, forming of a multi-color image in the embodiment is made by an image forming system. Data obtained by a color image data input unit in which a pick-up device scans an original image, is arithmetically computed by an image data processing unit to obtain image data. The image data are stored in an image memory once. For recording, then, the image data are read out and output to a recording unit (FIG. 1), which is, for example, the color image forming apparatus.

In other words, if a color signal output of an image reading apparatus which is separate from the aforesaid printer is input to the laser writing system unit 7, laser beam generated from a semiconductor laser (not shown) in the laser writing system unit 7 is rotationally scanned by a polygonal mirror 7B revolved by a drive motor 7A. The scanned laser beam is passed through a f*t lens 7C and is bent by mirrors 7D and 7E to be projected to the outside of the photoreceptor belt 1 having been charged by the scotron charger 6 in advance to form a bright line.

When the scanning is started, the laser beam is detected by a index sensor, and the modulation of the semiconductor beam is started by the first color signal. The modulated laser beam scans on the outside of the photoreceptor belt 1. With the scanning of the laser beam and the subscanning on the photoreceptor belt 1, a latent image corresponding to the first color is formed the outside of the photoreceptor belt 1. The latent image is developed by the developing assembly 8 having a toner (developing medium) of yellow (Y) contained therein to form a toner image on the drum surface. While the toner image obtained is held on the drum surface, it is passed under the cleaning arrangement 13 separated from the outside of the photoreceptor belt 1. This enters the next copying cycle.

That is, the photoreceptor belt 1 is charged by the scotron charger 6 again. The second color signal output of the image data processing unit is fed in the laser writing system unit 7. It is written on the drum surface as with the first color signal, to form a latent image. The latent image is developed by the developing section 9 having a toner of yellow (M) contained therein to form a toner image on the drum surface.

The magenta toner image is formed under existence of the yellow toner image formed already.

Similarly, a latent image formed by the third color image signal is developed by the developing section 10 containing cyan toner to form cyan toner image. A latent image formed by the fourth color image signal is developed by the developing section 11 containing black toner to form black toner image. These toner images are registered on the surface of the photoreceptor belt 1 to form a color toner images thereon.

The developing sleeves of the developing sections 8 through 11 have a dc and/or ac bias applied thereto, which can make a non-contact inversion development (jumping development) on the photoreceptor belt 1 substrate of which is grounded. It should be noted that the non-contact development method can alternatively use single component developing agent.

Thus, the color toner image formed on the surface of the photoreceptor belt 1 is transferred by a transfer arrangement 12 to transfer material supplied from a sheet feed cassette 14 through a sheet feed guide 15. For this, a top of the transfer material contained in the sheet feed cassette 14 is fed out of it to the transfer arrangement 12 by rotation of a sheet feed roller 16 in synchronization with the image forming on the photoreceptor belt 1 through a timing roller 17.

The transfer material having the color toner image transferred and discharged is securely separated from the photoreceptor belt 1 which abruptly changes its moving direction along with the revolving roller 2 of small curvature, and is carried up. The transfer material then has the toners melted and solidified by a fixing roller 18, and is discharged out through discharge roller 19 onto a tray formed on an upper cover 20.

On the other hand, the photoreceptor belt 1 having the transference of the color toner image to the transfer material completed is further carried, and has the remaining toner removed by the blade 13A of the cleaning arrangement 13 pressed thereto to clean, with the toner feed roller 13B pressed to the photoreceptor belt 1. After the cleaning, the blade 13A is separated from the photoreceptor belt 1 again, and a little later the toner feed roller 13B smooths the toner accumulated on a tip of the blade 13A and before being separated. The operation enters new image forming process.

The above mentioned photoreceptor drum 1, charger 6, developing sections, and cleaning arrangement 13 are integrated together in an independent process cartridge 30 as process resources for image forming. They can be mounted in or removed from the apparatus body as a unit.

Figure 3:
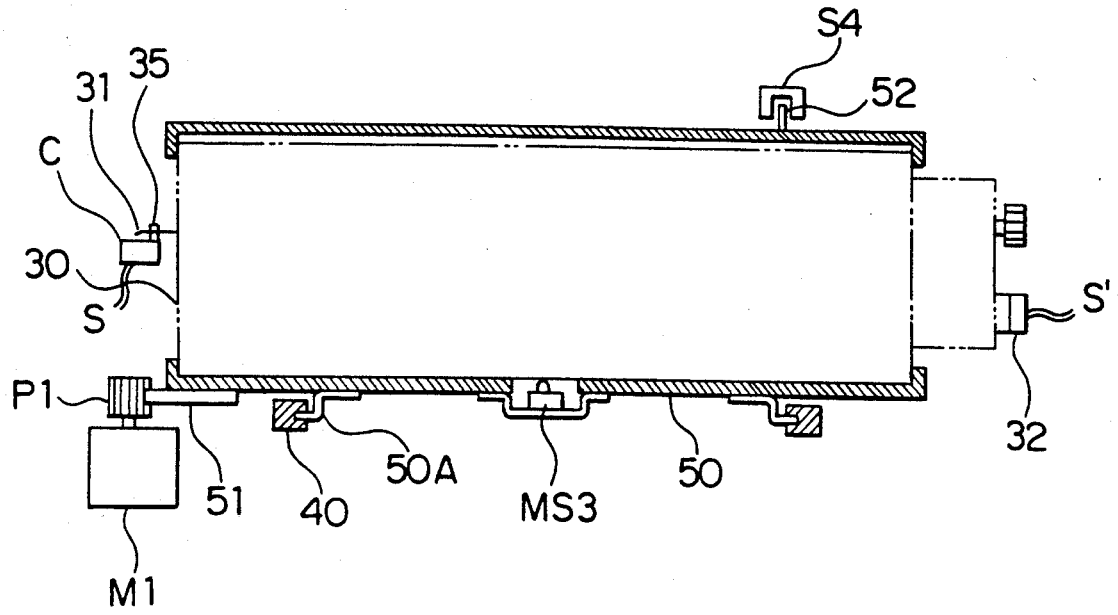
FIGS. 3 and 4 are a cross sectional side view of major sections and a side view of major sections of the image forming apparatus according to the present invention, respectively.
Figure 4:
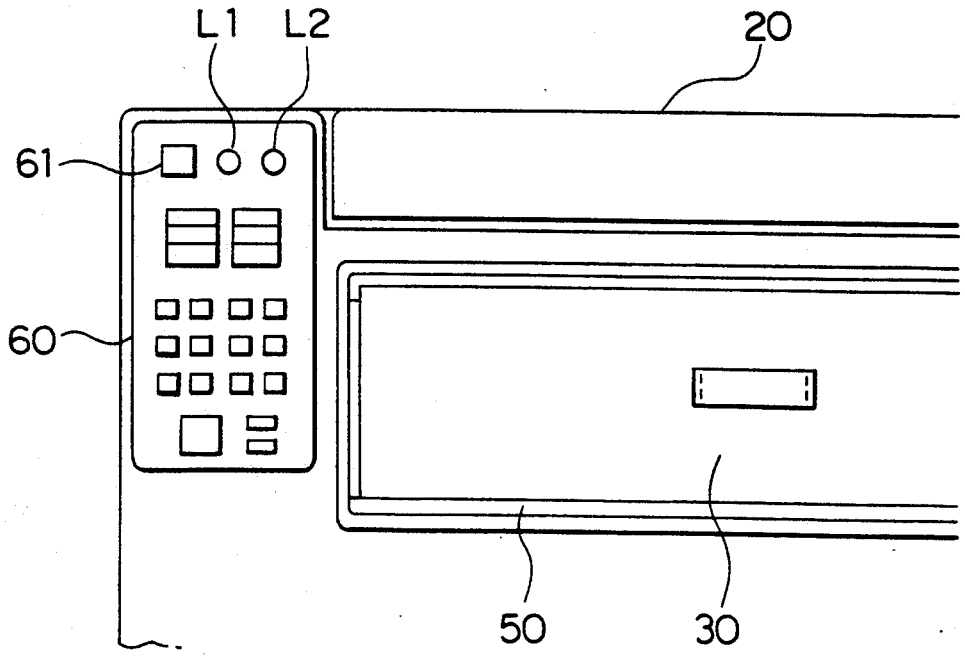

That is, a cartridge base 50, as shown in FIG. 3 which is a cross-sectional view taken across A—A in FIG. 1, in the apparatus body. The cartridge base 50 is slidably supported with feet 50A on a bottom thereof fitted with a pair of guide rails 40 fixed in place. The above mentioned process cartridge 30 is mounted on the cartridge base 50 to contain in the apparatus body.

Figure 2:
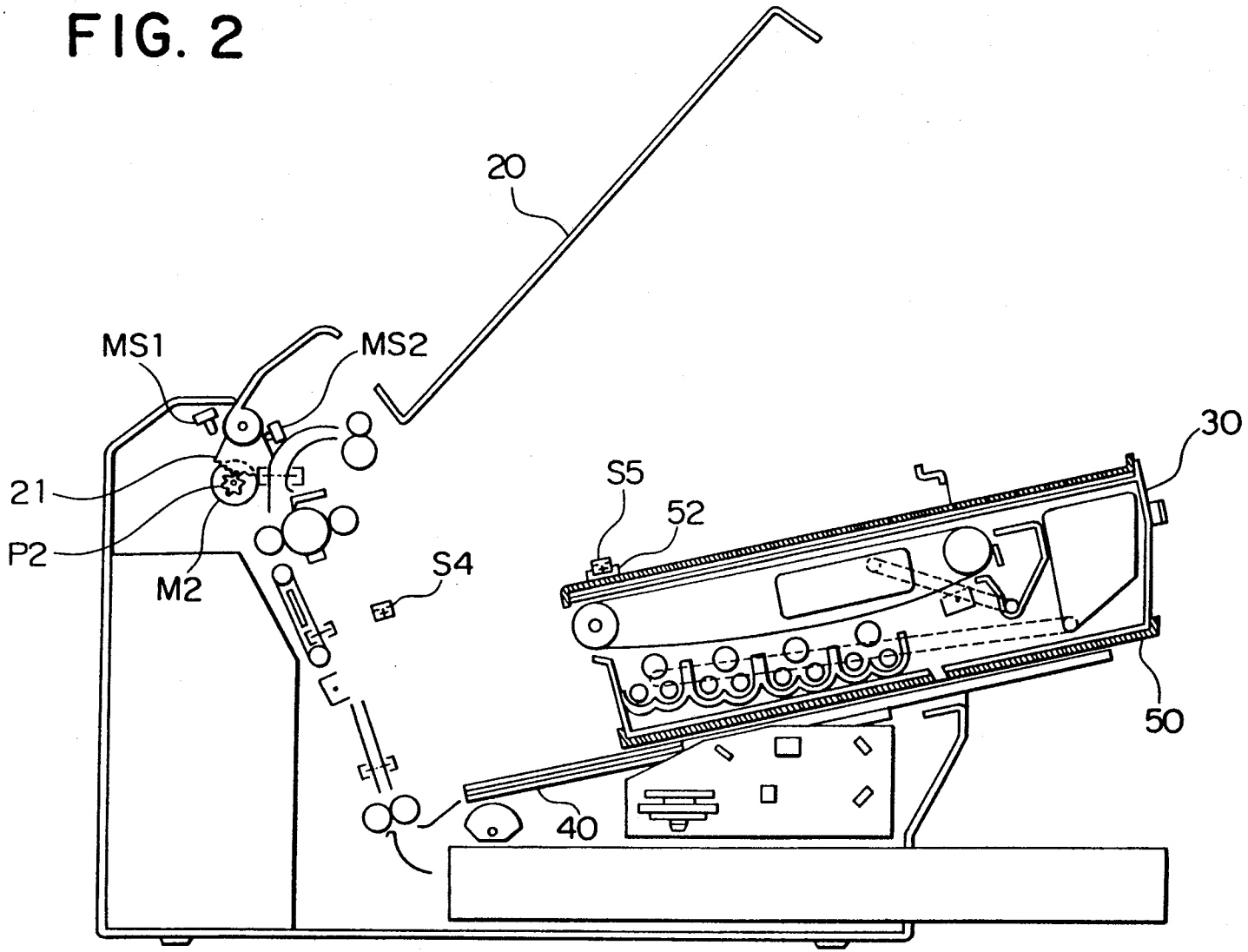

The cartridge base 50 has a rack plate 51 engaged with a pinion P1 of a motor M1 on the apparatus body. It, as shown in FIG. 2, is moved obliquely upward by the motor M1. (See FIG. 3.)

On the other hand, the upper cover 20 is turnably supported on the apparatus body with a shaft 20A. It can be turned counterclockwise to make a top of the apparatus body appear. That is, the upper cover 20 has a fan gear 21 on its end which is engaged with a pinion P2 of a motor M2 on the apparatus body. It, as shown in FIG. 2, is turned counterclockwise to a predetermined angle by the motor M2.

Movement of the cartridge base 50 and opening of the upper cover 20, or revolutions of the motors M1 and M2, are automatically started at the time of replacement or inspection of the process resources mentioned above or at the time of supply or feed trouble of the transfer material.

The process cartridge 30 mentioned above has a counter feature that can count frequency of the process resources contained. If new resources are loaded in the apparatus body, a projection member 31 on a side of the process cartridge 30 presses a reset lever 35 of a counter C provided on the apparatus body to reset it to 0. The counter C records the frequency of use. It feeds a signal S when as blade 13A of the cleaning arrangement 13 or the photoreceptor drum is used up to a predetermined frequency (reference value) of service life.

EXAMPLE

Reference frequency of cleaning blade to replace: 20,000 times.

Reference frequency of photoreceptor drum to replace: 60,000 times.

Cleaning blade replace signal is fed out upon: 20,000, 40,000, and 60,000 times.

Photoreceptor drum replace signal is fed out upon: 60,000 times.

The counter C is reset with insertion of a new process unit in use of 60,000 times.

The signal of the counter C informs the time to replace or check the photoreceptor drum 1, charger 6, developing sections, and cleaning arrangement 13.

It should be noted that the inventors' disclosure of the Japanese Utility Model Application Laid-Open No. 2-8295 is applied to the projection member 31. This can prevent the same process cartridge 30 from re-resetting the counter C.

The process cartridge 30 has sensors that can detect the toner remaining in the 30A and the toner collected in the waste toner cartridge 30B. When the toner is to be supplied or replaced, they feed a signal S' to the apparatus body through a connector 32 shown in FIG. 3. This informs the operator when the toner should be supplied or replaced. A operation and display panel 60 will receive and indicate the signal S or S' to replace or supply the resources mentioned above.

On the other hand, there are provided sensors S1, S2, S3, and the like on major points on which the transfer material passes. If one sensor on the lower course fails to detect the transfer material in a predetermined time after detection by another sensor on the upper stream, then a signal S" (not shown) is fed out as occurrence of jamming of the transfer material.

Any of the sensors can feed out a jamming release signal if it becomes no detection of the transfer material again when the jamming transfer material is taken out of the course during the output of the jamming detection signal.

The jamming detection or release signal is fed to the control unit of the apparatus body, which controls the motors M1 and M2. On the operation and display panel 60, on the other hand, a jamming indication lamp L1 is lit.

Figure 5:
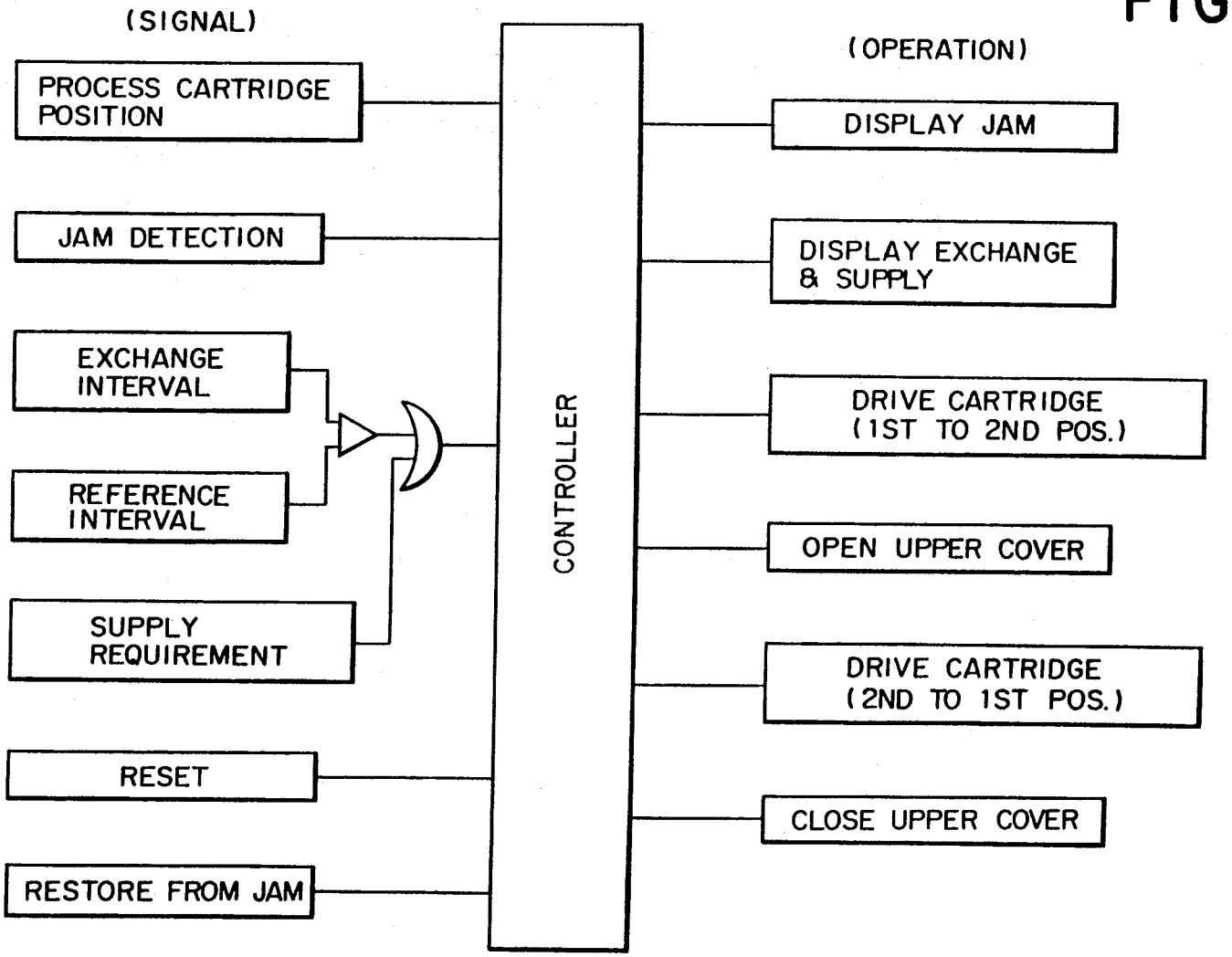
FIG. 5 is a bloc diagram, for a control circuit.
Figure 6A:
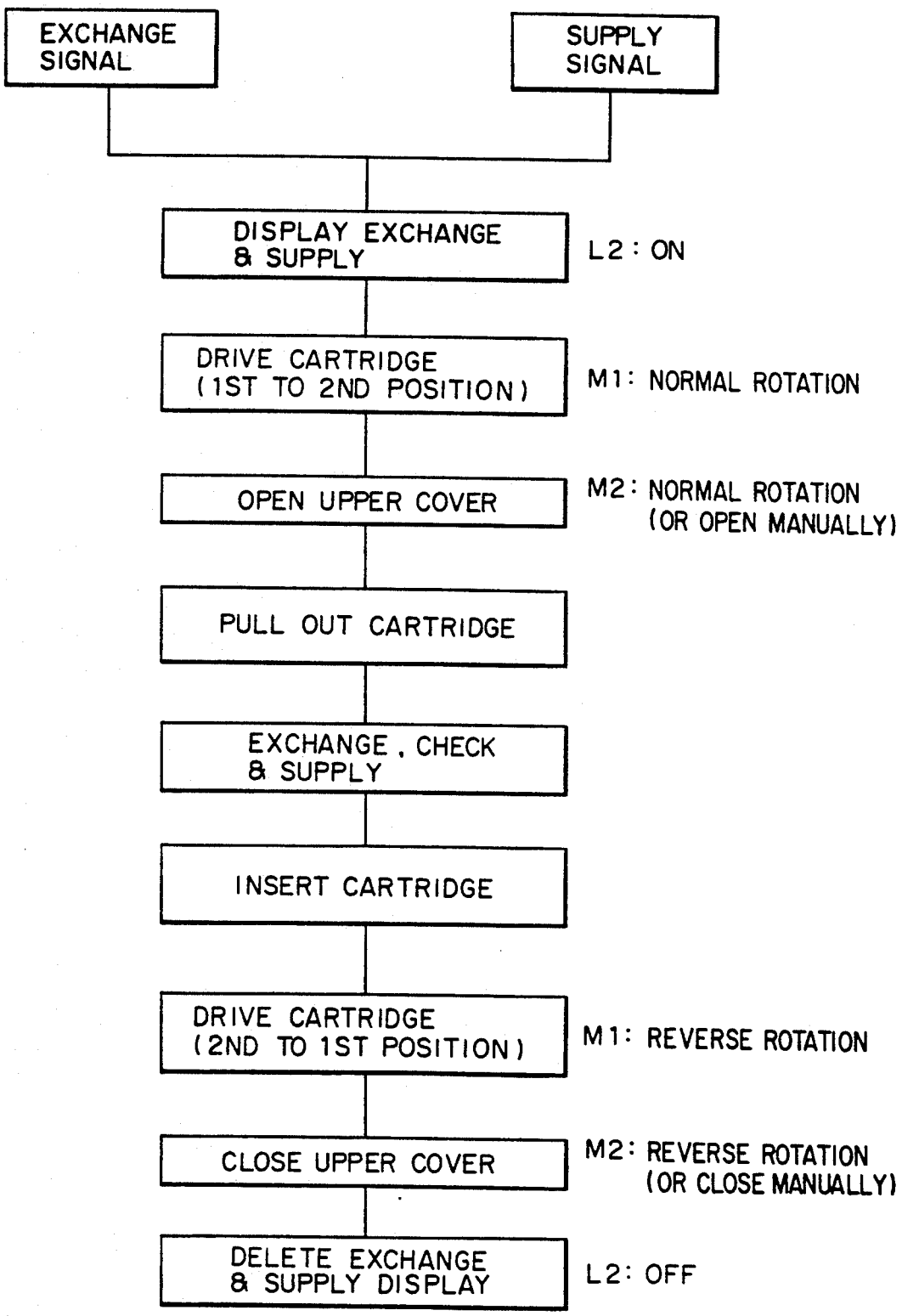
FIG. 6 consisting of FIGS. 6*a* and 6*b* is a flow chart for a control process.
Figure 6B:
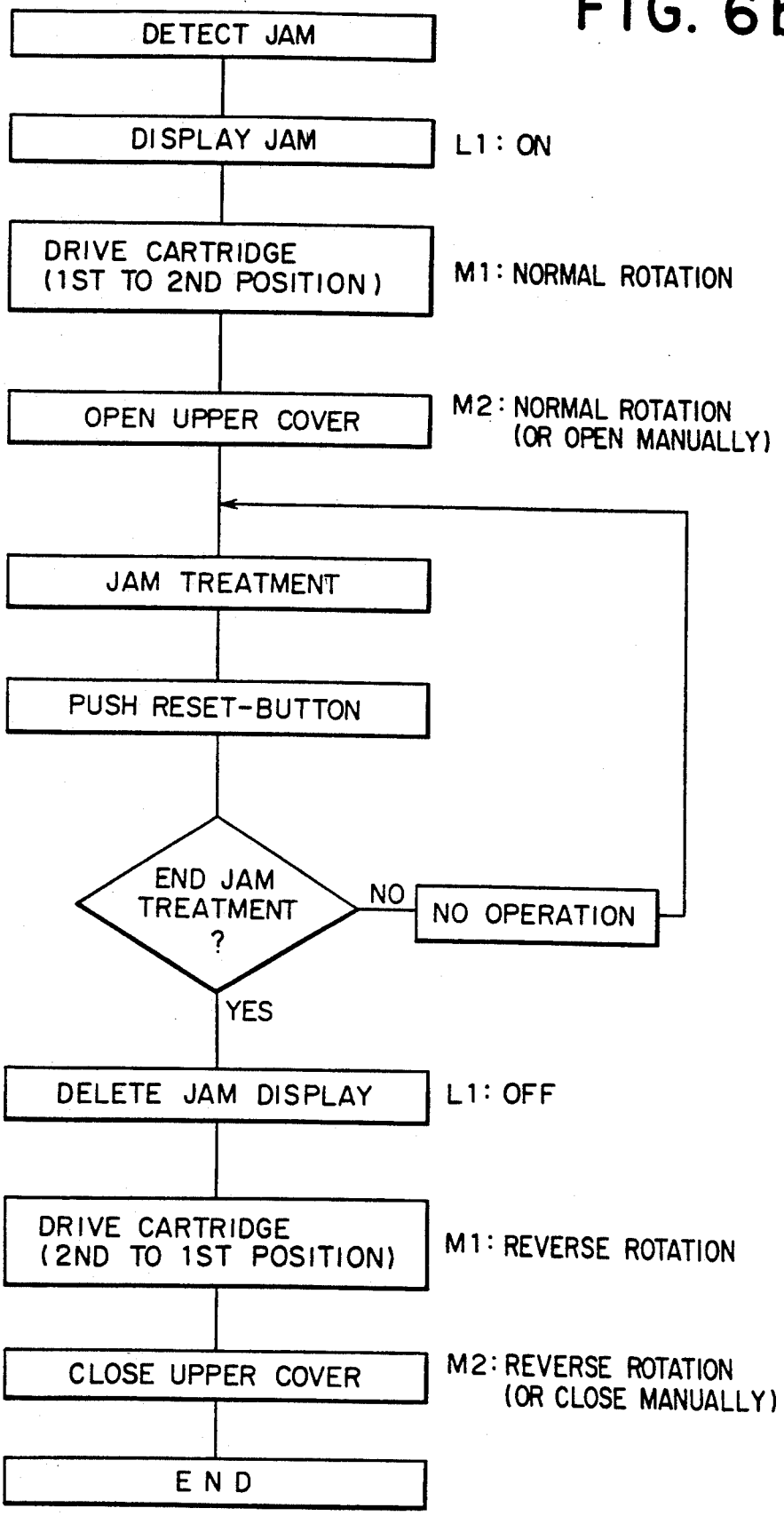

The following describes the revolution control process of the motors M1 and M2 by the above mentioned signals by reference to FIG. 5, a block diagram for controlling the motors, and FIG. 6, a flow chart for controlling the motors.

The operation and display panel 60 provided on the front of the apparatus body, or on a side indicated by a directed line B in FIG. 1, has a lamp L1 for indicating occurrence of jamming of the transfer material, a lamp L2 for indicating replacement or supply of the process resources, and a reset button 61 for allowing the motors M1 and M2 to reversely revolve.

If any of the jamming detection signal S" and the process resource replacement and supply detection signal S or S' is fed to the control unit of the apparatus body, the lamps L1 and L2 are lit, respectively.

At the same time as either of the detection signals is input for indication, a signal is fed out to allow power to be supplied to the motors M1 and M2 to revolve normally.

With the normal revolution of the motor M1, the cartridge base 50 is moved from a position shown in FIG. 1 to another position in FIG. 2. The M1 stops when a light shield plate 52 provided above it comes to a position at which it turns a photosensor S5 off.

As a result, the process cartridge 30 is moved from a first position where image forming can be made in the apparatus to a second position where it can be removed or mounted. In that state, it can be easily taken out of the cartridge base 50, allowing efficient replacement, inspection, or supply of the process resources.

In continuation to or parallel with it, the motor M2 revolves normally to turn the upper cover 20 from an angle shown in FIG. 1 to another angle in FIG. 2. This makes the top of the apparatus body appear. When the upper cover 20 turns to another angle where the fan gear 21 presses a microswitch MS of the apparatus body to turn off, the motor M2 is stopped. It allows the operator to easily remove the jammed transfer material with the process cartridge 30 moved.

After the process cartridge 30 is taken out of the cartridge base 50 for replacement or supply of the process resources, it can be mounted on the cartridge base 50 again as specified in FIG. 6-a. A bottom of the process cartridge 30 presses a microswitch MS3 to turn on to feed a store detection signal for the process cartridge 30. A signal is output to supply power to the motors M1 and M2 to revolve reversely.

As a result, the process cartridge 30 is returned from the second position to the first position. If it comes to a position at which the light shield plate 52 turns the photosensor S4 off, the motor M1 stops. The process resources are kept in a state that image forming can be made.

With the motor M2 revolving reversely, the upper cover 20 is turned clockwise and stopped at an angle at which the fan gear 21 turns a microswitch MS1 on. This closes the top of the apparatus body and turns the lamp off, allowing copy.

After clearing the transfer material from jamming in the image forming apparatus according to the present invention, the operator should press the reset button 61. This forms a switching circuit for turning off the lamp L1 and a power supply circuit for supplying a reverse revolution power to the motors M1 and M2.

The photosensors S1, S2, and S3 are returned to the states that they do not detect the transfer material after this is removed from the feed path. When the jamming release signal is fed out, the switching circuit and the power supply circuit are connected together, the lamp L1 is gone off to turn the jamming indication off. The motors M1 and M2 start reverse revolution to move the process cartridge 30 from the second position to the first position. They also turn the upper cover 20 clockwise to close.

Therefore, in the image forming apparatus according to the present invention, the jamming indication cannot be gone off even if the reset button 61 is pressed unless the jamming transfer material is cleared off. The motors M1 and M2 cannot be revolved reversely. The apparatus body is kept in the state shown in FIG. 2. This prompts the operator to clear the transfer material from jamming completely.

The upper cover 20 can be opened or closed by hand in view of safe operation. The operator has to make sure that the lamp L1 is turned on and off before opening or closing it.

Figure 7:
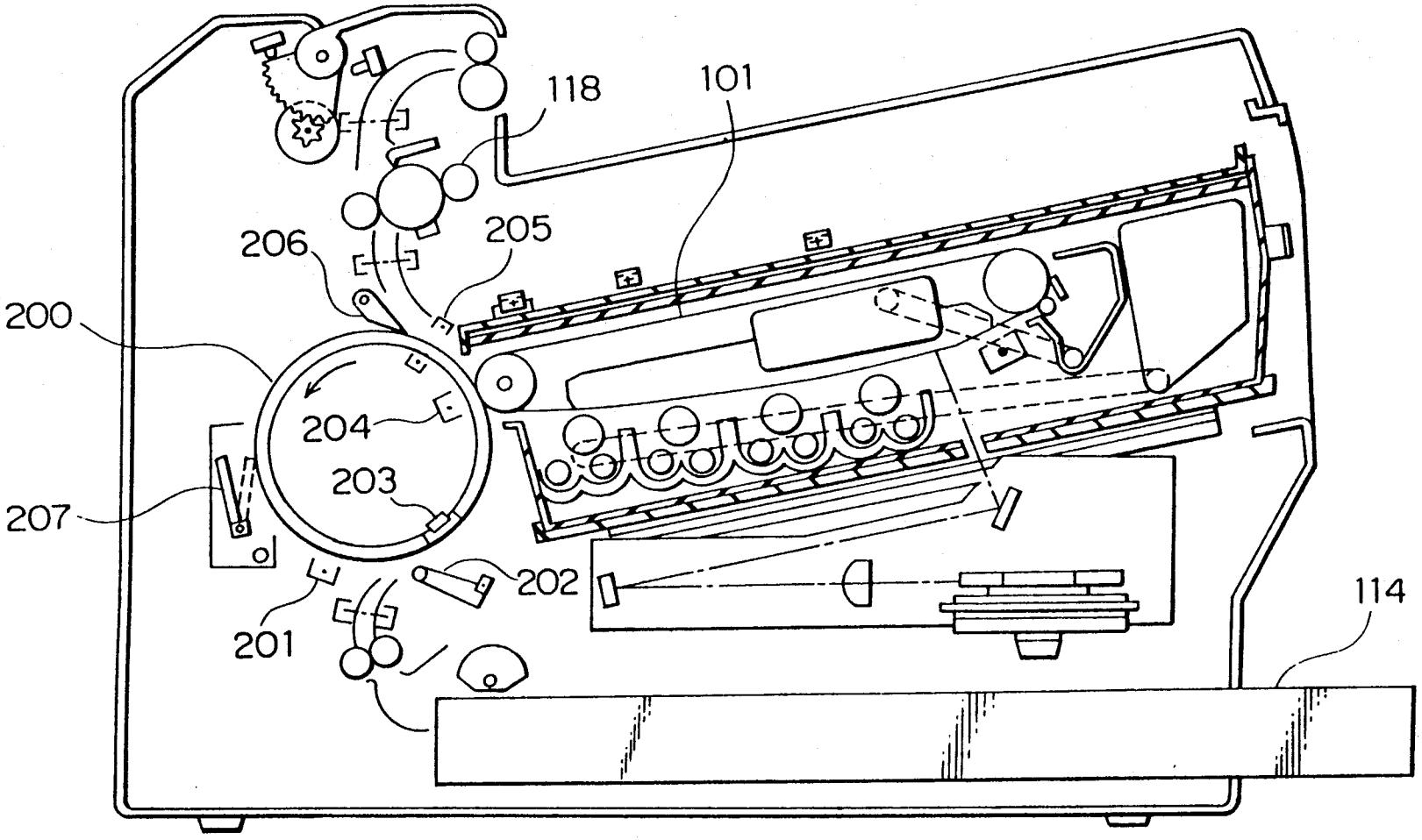

FIG. 7 is a cross sectional view of another embodiment of the present invention for the image forming apparatus of transfer drum type. The photoreceptor belt 101 and the process cartridge provided near it are roughly the same as in the preceding embodiment except a transfer drum 200 is fitted to its transfer portion. The transfer drum 200 is revolved in an arrow direction (counterclockwise) as synchronized with the photoreceptor 101.

When the transfer material is wound on the transfer drum 200, a toner image is transferred to the wound transfer material. Other toner images are superimposed on the preceding one. The transfer material is separated from the transfer drum 200. It is fixed and then discharged onto the top of the apparatus body.

There are provided around the transfer drum 200 a charger 201 for electrostatically adsorb the transfer material and a winding member 202 for mechanically winding the transfer material on the transfer material. The winding member 202 has a roller at its end. The roller is fitted to the transfer material when this starts winding on the on the transfer drum 200. The transfer drum 200 has a gripper 203 on its surface. The gripper 203 holds an end of the transfer material as synchronized with the feed of the transfer material.

There is provided a transfer arrangement 204 which can electrostatically transfer the toner image on the photoreceptor belt 101 to the transfer material. There are also provided a separation and discharge electrode 205 and a separation pawl 206. There is further provided a detouchable cleaner 207 which, after separation of the transfer material, can eliminate the toner from the transfer drum 200.

The transfer material taken out of the sheet feed cassette 114 is synchronized with and made to enter the transfer drum 200 charged by the charger 201 and is wound on it by a winding member 202. It is turned to the transfer section with its end held by a gripper 203. In the transfer section, the transfer arrangement 204 transfers the yellow (Y) toner image formed on the photoreceptor belt 101 onto the transfer material. After completion of the first transference, the transfer drum 200 continues turning to superimpose the magenta (M) toner image in the second turn, the cyan (C) toner image in the third turn, and the black (Bk) toner image in sequence. After completion of transference of all the four color toner images, the transfer material is discharged by a separation and discharge electrode 205. Its end is released by a separation pawl 206. The transfer material is separated and feed to a fixing roller 118.

In the image forming apparatus in the embodiment described above, the transfer drum 200 is not contained in the process cartridge which can be made to move and to be removed. Insertion or removal of the process cartridge and clearing of jamming, therefore, can be made in the same way as in the previous embodiment.

Figure 8A:
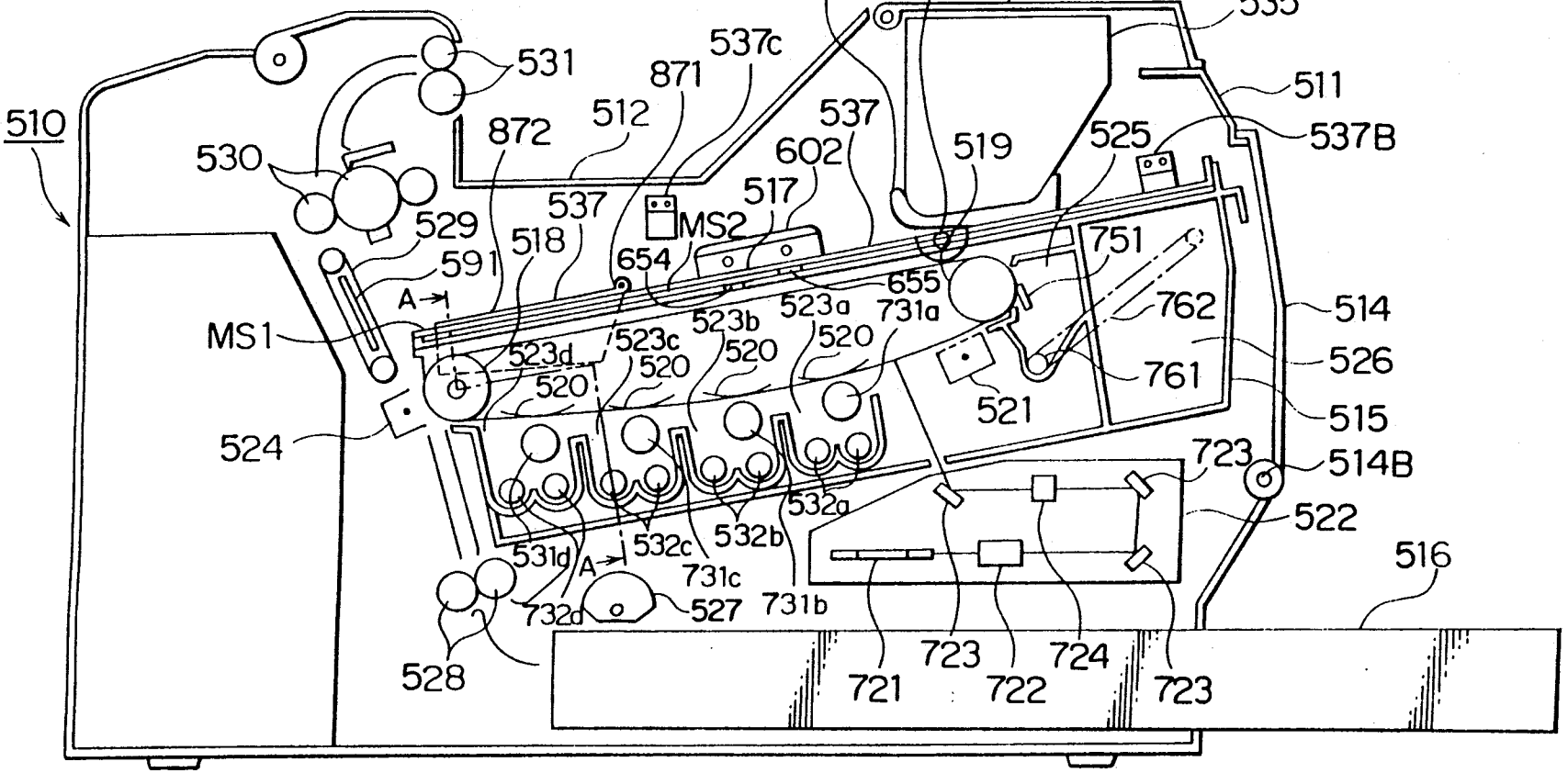
FIGS. 8-a and 8-b are side views of major sections of a color printer in another embodiment according to the present invention.
Figure 8B:
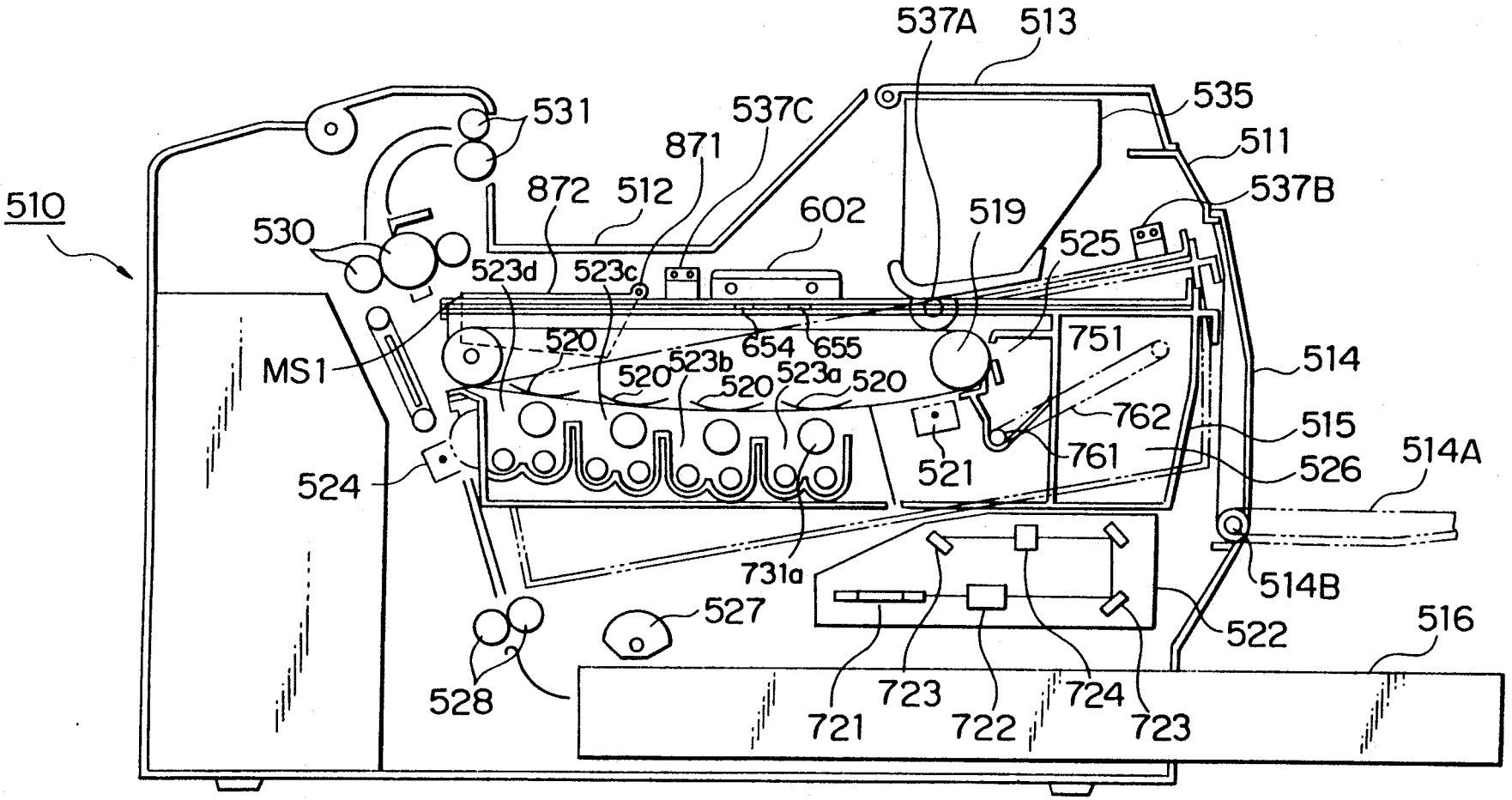

Referring now to the figures, another embodiment of the image forming apparatus of the present invention will be described below. FIGS. 8-a and 8-b are a left side view of major sections of a color printer according to the present invention. As shown in the figure, a apparatus body 510 is enclosed by an operation panel 511 in front thereof, an openable upper cover 512, a toner supply cover 513, a front cover 514, and others. It has a demountable process cartridge 515 and a sheet feed cassette 516 provided therein. FIG. 8-a shows when the process cartridge is at a first position at which it can make image forming. FIG. 8-b shows that the process cartridge is horizontally turned together with a guide rail 537 to release the it to a second position.

In FIG. 8-a, a photoreceptor belt 517 which is an image carrier has a light sensitive layer coated on surface of flexible belt, being provided between a drive roller 518 and a driven roller 519. The drive roller 518, as will be described later, is revolved by a drive gear engaged with a gear provided in the apparatus body 510 to carry the photoreceptor belt 517 clockwise. A gap retaining member 520 is provided to keep constant gaps between the photoreceptor belt 517 and developing sections 523*a* through 523*d* for forming stable quality images. It should be noted that the first embodiment uses the photoreceptor belt 517 as the image carrier, but the present invention shall not be limited to it, but can use any of the conventional image carriers having the light sensing layer, such as a photoreceptor drum.

There are provided around the photoreceptor belt 517 a charging device 521, an semiconductor laser write system unit 522, the developing sections 523*a* through 523*d*, a transfer arrangement 524, and a cleaning arrangement 525.

The charging device 521 is provided to uniformly charge the light sensing layer on the photoreceptor belt 517 with predetermined polarization, being made of any of the conventional chargers, such as a corona charger and a scorotron charger. The scorotron charger has been preferably used for OPC photoreceptor.

The semiconductor laser write stem unit 522 is a semiconductor laser writing system unit which can expose the surface of the photoreceptor belt 517 charged by the charging device 521 to form an electrostatic latent image.

The developing sections 523*a* through 523*d* include a plurality of developing sections containing toners (developers) of different coolers, for example, yellow, magenta, cyan, and black toners. Each of the developing sections 523*a* through 523*d* have developing sleeves 731*a* through 731*d* to keep the predetermined gaps from the photoreceptor belt 517 and stirring screws 732*a* through 532*d* to stir the color toners, respectively. It can develop the latent toner image on the photoreceptor belt 517 in a non-contact development method. The non-contact development method, unlike the contact development method, is preferable for obtaining good color image as it will not injure the toner image formed on the photoreceptor belt 517 and will not prevent the photoreceptor belt 517 from moving. The developing sections 523*a* through 523*d* are not limited to the four color toners for color development as in the embodiment, but can use a single, two, or three color toners. Number of the developing sections needed around the photoreceptor belt 17 is that of the toners.

The transfer arrangement 524 which is made of, for example, a transfer corona discharger can transfer the toner image formed on the photoreceptor belt 517 onto transfer material. It may be replaced by any of the conventional transfer member, such as a transfer drum.

The cleaning arrangement 525 which has a cleaning blade 751 is kept separated from the surface of the photoreceptor belt 517 during image forming process, but is pressed to the surface to clean the photoreceptor belt 517 only during cleaning after transference of the toner image to the transfer material.

A waste toner collection box 526 collects through a waste toner collection tube 762 the toner removed from the surface of the photoreceptor belt 517 by a waste toner screw 761.

In the first embodiment, the above mentioned processing sections, including the photoreceptor belt 517, the charging device 521, the developing sections 523*a* through 523*d* containing the respective toners, the cleaning arrangement 525, and the waste toner collection box 526, which form an image forming unit of the above mentioned color printer, are integrated together to one unit in the process cartridge 515 so that this can be mounted in or demounted from the apparatus body 510. However, the processing sections integrated in the process cartridge 515 may not be limited these, but they should include at least the photoreceptor belt 517 and the developing sections 523*a* through 523*d* or the photoreceptor belt 517 or the cleaning arrangement 525. The other processing sections may be integrated together with them.

The following describes color image forming process carried by the color image forming apparatus constructed as described above.

First, the process cartridge 515, as shown in FIG. 8-a, is loaded at a first position where image forming can be made. If a first color image signal fed out of an image reading unit separated from the apparatus body 510 is input to the semiconductor laser write system unit 522, then a semiconductor laser (not shown) of the semiconductor laser write system unit 522 generates laser beam. The laser beam can be revolved and scanned by a polygonal mirror 721 revolved by a drive motor (not shown). It, then, is projected via a f*t lens 722, a cylindrical lens 724, and three mirrors 723 onto the surface of the photoreceptor belt 517 having uniformly charged to a predetermined level by a charging device 521 in advance to form bright line thereon.

On the other hand, a belt index (not shown) corresponding to a specific position on the photoreceptor belt 517, or a print command signal is received as to a sub-scanning direction. Based on the detected or command signal, a main scanning line is determined to start modulation of the semiconductor laser by an image signal. With the start of scanning, the laser beam is detected by the index sensor (not shown) as to the main scanning direction. Based on the detected signal, the first color image signal is started to modulate the semiconductor laser. The modulated laser beam is made to scan on the surface of the photoreceptor belt 517. The main scanning by the laser beam and the sub-scanning by the movement of the photoreceptor belt 517 can form a latent image corresponding to the first color on the surface of the photoreceptor belt 517. The latent image is developed by the developing section 523*a* of the developing assembly containing the yellow toner corresponding the first color to form an yellow toner image on the surface of the photoreceptor belt 517. After this, the photoreceptor belt 517 is made to pass under the cleaning blade 751 separated from the surface thereof while holding the yellow toner image thereon, and enters a second color image forming process.

That is, the photoreceptor belt 517 having the yellow toner image formed thereon is charged by the charging device 521 again. A second color image signal is input to the semiconductor laser write system unit 522, and is written onto the surface of the photoreceptor belt 517 to form a latent image as for the first color image signal. The latent image is developed by the developing section 523*b* containing the magenta toner as a second color. The magenta toner image is formed under existence of the yellow toner image formed already.

Similarly, a latent image formed by a third color image signal is developed by the developing section 523*c* containing cyan toner to form cyan toner image. A latent image formed by a fourth color image signal is developed by the developing section 523*d* containing black toner to form black toner image. These toner images are registered on the surface of the photoreceptor belt 517 to form a color toner images thereon.

The developing sleeves 731*a* through 731*d* of the developing sections 523*a* through 523*d* have a dc and/or ac bias applied thereto, which can make a non-contact inversion development (jumping development) on the photoreceptor belt 517 substrate of which is grounded. It should be noted that the non-contact development method can use either one or two component developing agents. With use of the one component developing agent, no separate tone hopper is needed, allowing smaller construction of the apparatus. The developing method using the two component developing agents, however, is more preferable in color reproduction than that as it provides higher development stability.

As described above, the color tone image formed on the surface of the photoreceptor belt 517 is transferred to transfer material supplied from the sheet feed cassette 516 by a sheet feed roller 527 as synchronized in time with the color toner image by a timing roller 528. The transference is made by the transfer arrangement 524 which applies a high voltage of polarity opposite to that of the toner.

The transfer material having the color toner image transferred so far is securely separated from the photoreceptor belt 517 which abruptly changes its moving direction along with the drive roller 518 of small curvature, and is carried up by a carrying belt 529. A suction device 791 of the carrying belt 529 can suck the transfer material to securely carry up. The transfer material then has the toners melted and solidified by a fixing roller 530, and is discharged out by a sheet discharge roller 531 onto the operation panel 511 which also serves as discharged paper tray.

On the other hand, the photoreceptor belt 517 having the transference of the color toner image to the transfer material completed is further carried clockwise. It passes an action block 602 having a discharge unit comprising a discharge lamp or discharge electrode or an exposure arrangement provided thereon to discharge its surface. It has the remaining toner removed by the cleaning blade 751 of the cleaning arrangement 525 pressed thereto to clean. After the cleaning, the cleaning blade 751 is separated from the photoreceptor belt 517 again. The operation enters new image forming process.

In turn, the following describes about a drive system for the process cartridge 515 and another drive system for moving the process cartridge 515 by reference to FIGS. 9 through 12.

Figure 9:
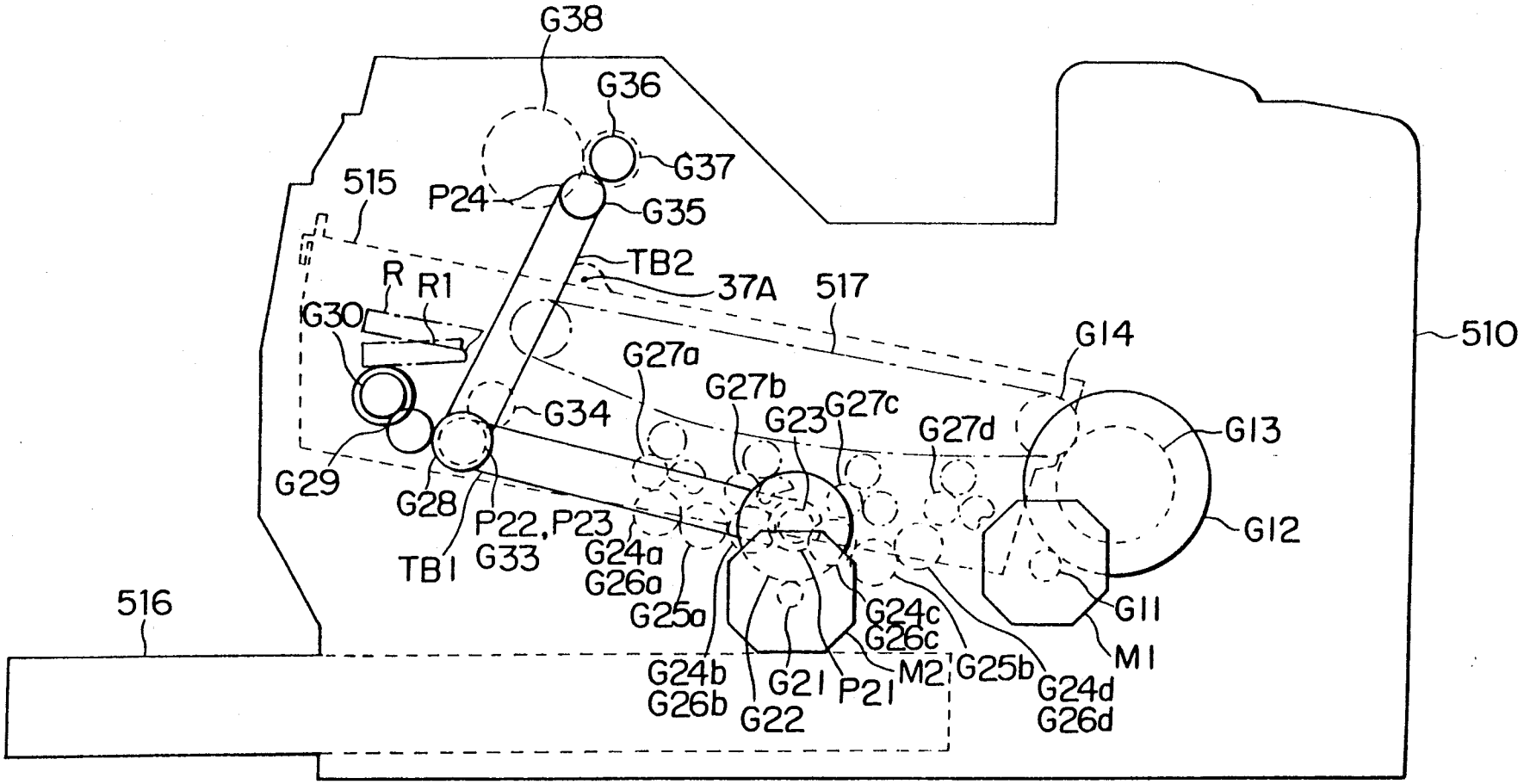
FIG. 9 is a right side view of the drive system of the present invention.

FIG. 9 is a right side view of the drive system for the process cartridge 515 and the drive system for moving the process cartridge 515. The drive operations are made by two motors M1 and M2.

First, the drive system for the photoreceptor belt 517 uses the motor M1. A gear G12 is arranged so as to engage with a gear G11 on a shaft of the motor M1. If the process cartridge 515 is at a position at which image forming can be made, a gear G14 coaxially provided on the drive roller 518 for carrying the photoreceptor belt 517 is engaged with a gear G13 which is revolved together with the gear G12. In other words, revolution of the motor M1 is transmitted through the gear G11, the gear G12, and gear G13 to the gear G14 to adjust its speed, and also revolves the drive roller 518 together with the gear G14 counterclockwise in the figure to carry the photoreceptor belt 517.

Figure 10:
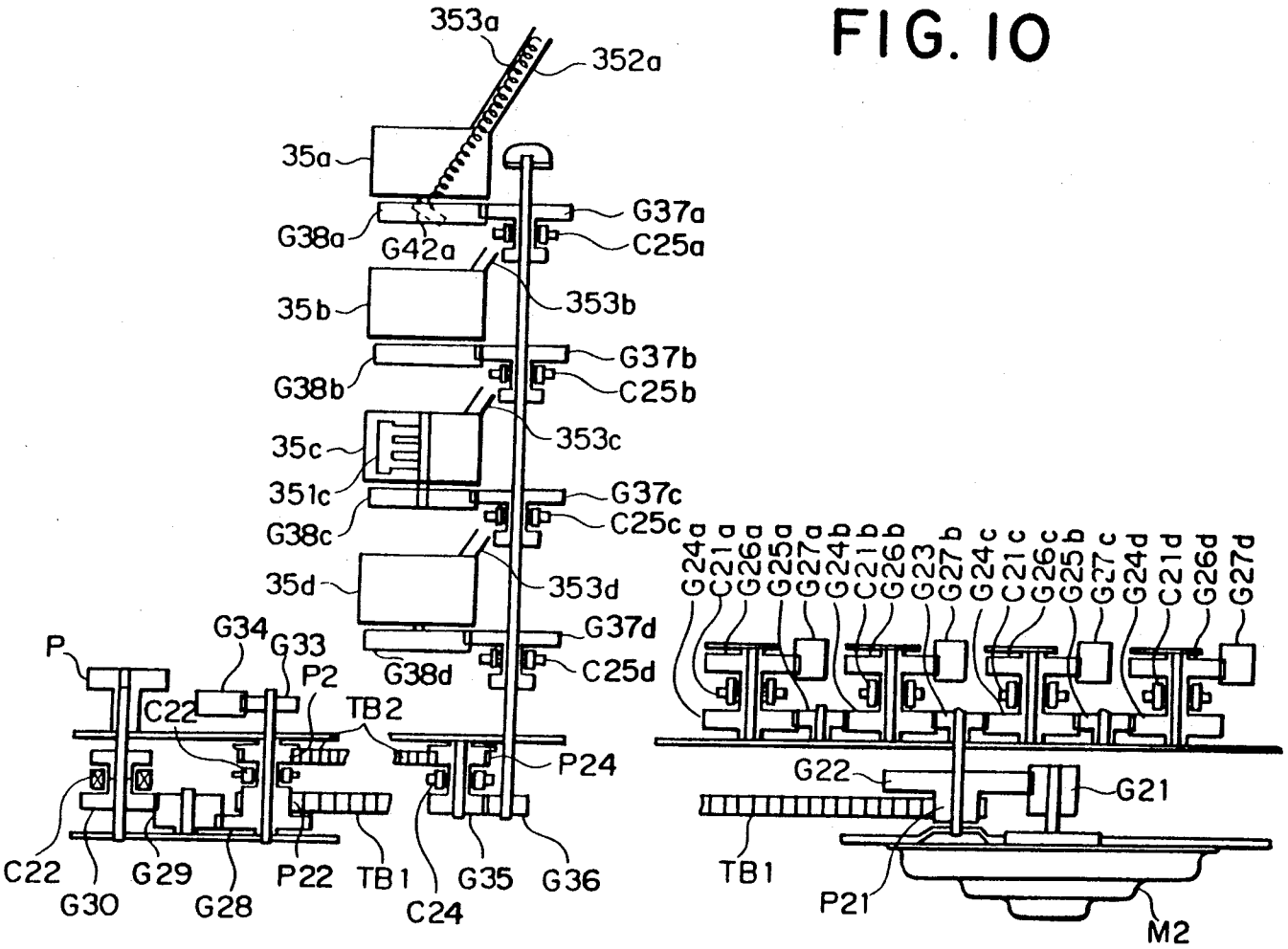
FIG. 10 is plan views illustrating a process cartridge moving drive system and a cassette moving drive system.
Figure 11:
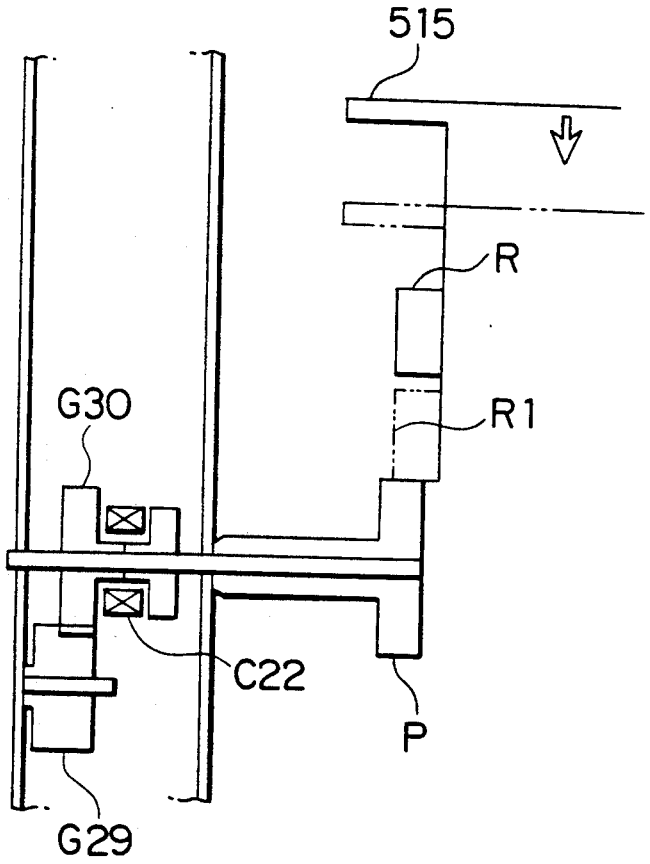
FIG. 11 is a view for a major section illustrating the process cartridge moving drive system.

In turn, the following describes the developing sections 523*a* through 523*d*, the waste toner screw 761, the toner hopper 535, and the drive system for the moving arrangement for the process cartridge 515 by reference to FIGS. 9 and 10.

The drive system uses the motor M2. Revolution of the motor M2 is transmitted through a gear G21 on the motor M2 to a gear G22, and also is transmitted to a gear G23 coaxially provided on the gear G22 to drive the developing sections 523*a* through 523*d*.

First, the following describes a drive system for the developing sections 523*a* through 523*d*.

The revolution of the motor M2 transmitted to the gear G23 is transmitted to a gear G24*b* and a gear G24*c*, and also is transmitted through a gear G25*a* and a gear G25*b* to a gear G24*a* and a gear G24*d*. There are further arranged gears G26*a* through G26*d* coaxially with the gears G24*a* through G24*d* so as to engage with G27*a* through G27*d* provided in the process cartridge 515 through spring clutches C21*a* through C21*d* of open type to make revolution transmission in only one direction when the process cartridge 515 is at the position at which the image forming can be made. The revolution transmitted to the gears G27*a* through G27*d* is transmitted through gears provided on the process cartridge 515 to the developing sleeves 731*a* through 731*d* and the stirring screws 732*a* through 732*d* to drive the developing unit. In other words, the revolution of the motor M2 is transmitted through the gear G21, the gear G22, and the gear G23 to the gear G24*b* and the gear G24*c*, and further is transmitted through the gear G25*a* and the gear G25*b* to the gear G24*a* and the gear G24*b*. It also is connected with the clutches to transmitted to the gears G27*a* through G27*d* to drive the developing sections 523*a* through through 523*d* as necessary. Of the developing sections 523*a* through 523*d*, only the developing section corresponding to the particular color being image formed should be driven, and the developing sections 523*a* through 523*d* should not be driven if the process cartridge 515 or the sheet feed cassette 516 is moved as will be described later. For the purpose, pawls of cams (not shown) touching ratchets (not shown) of the spring clutches C21*a* through C21*d* are shifted in phase, and a step motor (not shown) should be provided to control for selection of one of five positions, including the four cam positions and an additional position to which no clutches can be connected. For example, the four cam pawls corresponding to the respective clutches should be coaxially shifted by 72 degrees each, and the step motor should be turned every 72 degrees so that only one of the developing sections 523*a* through 523*d* can be driven or none of them can be driven.

In turn, the following describes the moving arrangement for the process cartridge 515.

The revolution of the motor M2 transmitted to the gear G22 is transmitted through a pulley P21 revolving together with the gear G22 and a timing belt TB1 to a pulley P22 to drive the drive system for the moving arrangement for the process cartridge 515.

In the drive system for the moving arrangement for the cartridge 15, the revolution transmitted to the pulley P22 is transmitted to a gear G29 engaged with a gear G28 revolving together with the pulley P22. The revolution of the motor M2 transmitted to the gear G29 is further transmitted to a gear G30 engaged with the gear G29. The revolution also is transmitted through an electromagnetic clutch C22 to a pinion P as necessary (see FIG. 11). The pinion P can be engaged with a rack R provided on a side of the process cartridge 515 as the process cartridge 515 is turned to become horizontal. Revolution of the pinion P and sliding of the rack R move the process cartridge 515 right and left as will be described in detail later.

The following describes the drive system for the waste toner collection box 526. The revolution of the motor M2 transmitted pulley P22 is transmitted through a spring clutch C22A of open type to a pulley P23 to the drive system of the waste toner screw 761.

In the drive system of the waste toner screw 761, a gear G33 revolving with the pulley P23 engages with a gear G34 provided on a side of the process cartridge 515 to transmit the revolution from the pulley P23 to the waste toner screw 761. The waste toner screw 761 carries the toner removed from the photoreceptor belt 517 by the cleaning arrangement 525 through the waste toner collection tube 762 having a revolving coil spring to the waste toner collection box 526.

In turn, the following describes the drive system for the toner hoppers 535*a* through 535*d*. The revolution of the motor M2 transmitted to the pulley P23 is transmitted through a timing belt TB2 to a pulley P24, through a C24 to a gear G35 as needed, and to a gear G36 engaging with the gear G35. It is further connected with spring clutches C25*a* through C25*d* to revolve gears G38*a* through G38*d* engaged with gears G37*a* through G37*d* revolving together with the gear G36. Toner hopper stirring members 851*a* through 851*d* are revolved together with the gears G38*a* through G38*d* to stir the supply toner in the toner hoppers 535*a* through 535*d* and at the same time, toner supply screws 852*a* through 852*d* coaxially provided with gears G39*a* through G39*d* engaging with the gears G38*a* through G38*d* are revolved to carry the supply toner into the developing sections 523*a* through 523*d* in the process cartridge 515.

The toner hoppers 535*a* through 535*d* are driven accordingly as the developing sections 523*a* through 523*d* are driven. That is, if the developing section corresponding to the color being image formed is driven, only the toner hopper containing the supply toner of the same color can be driven. To control the drive, the spring clutches C25*a* through C25*d* are used, and another step motor and cams (not shown) are used as in controlling the drive of the developing sections.

The first embodiment, as described above, uses the two motors, the motor M1 for the drive system for the photoreceptor belt 517 and the motor M2 for the developing sections 523*a* through 523*d*, the waste toner screw 761, the toner hopper 535, and the drive system for the moving arrangement for the process cartridge 515. These drives, however, may be made by a single motor. Or, it need hardly be said that a motor may be provided only for the moving arrangement for the process cartridge 515.

Figure 12:
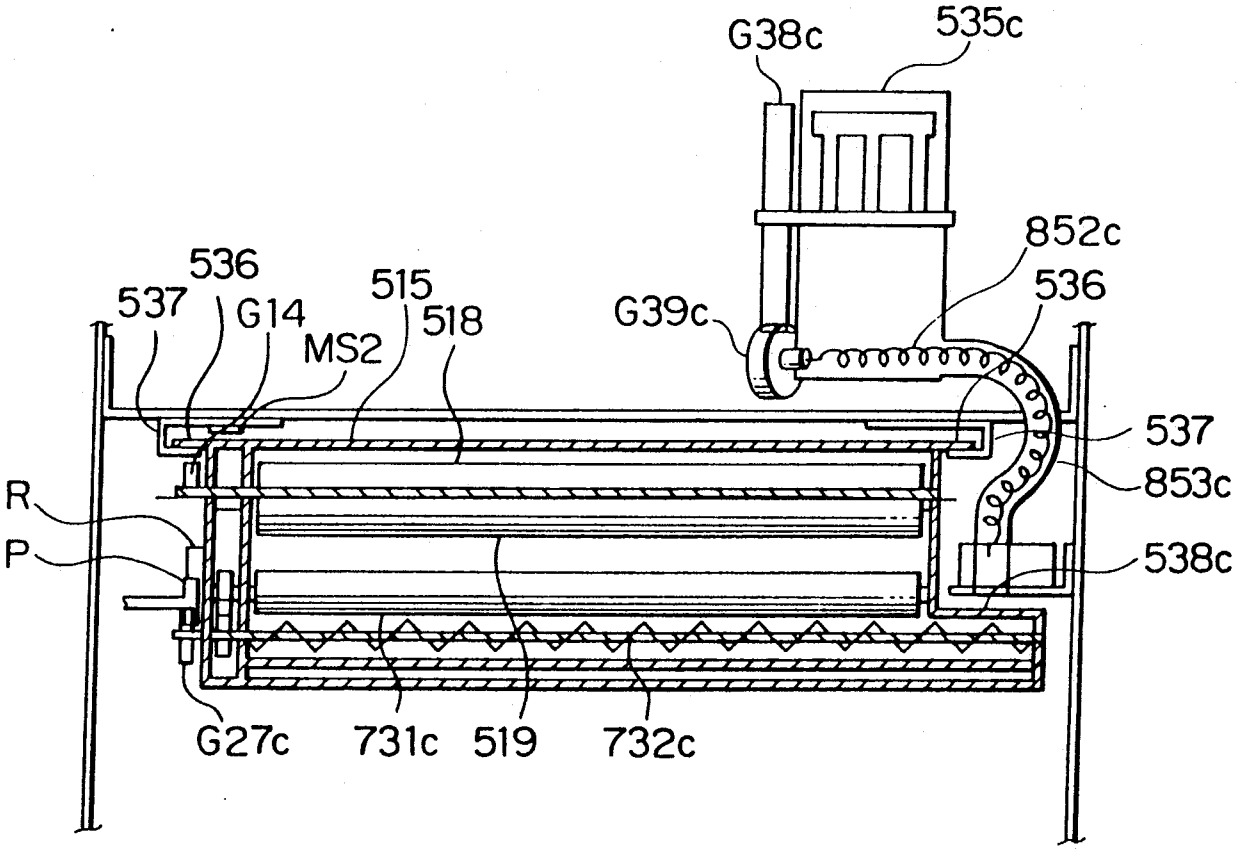
FIG. 12 is a cross-sectional view taken across A—A in FIGS. 8-a and 8-b.
Figures 13A, 13B, 13C:
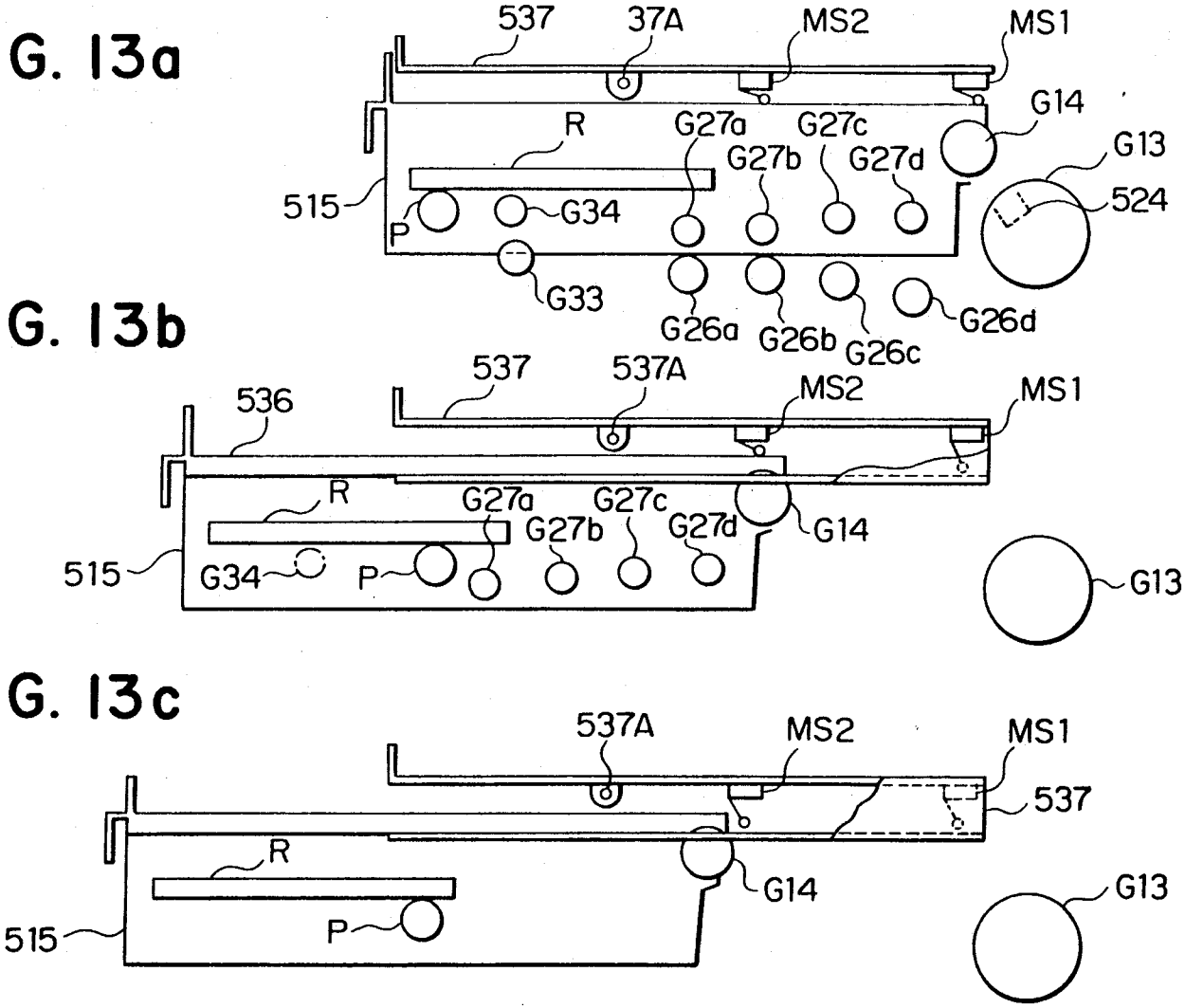
FIGS. 13-a through 13-c illustrate the movement of the process cartridge.

In turn, the following describes the movement of the process cartridge 515 by reference to FIG. 12 which is a cross-sectional view taken across A—A' in FIG. 8 and to FIG. 13 which illustrates the movement. The process cartridge 515 has a projection member 536 and the rack R to move aside, and has the gear G14, the gear G27*a* through G27*d*, and the gear G34 to make image forming.

On the other hand, the process cartridge 515 of the apparatus body 510 has a guide member 537 to guide insertion or removal thereof provided therein with the guide member 537 hanging the process cartridge 515 to guide as the projection member 536 of the process cartridge 515 is inserted. It also has the gear G13, the gears G26*a* through G26*d*, and the gear G33 provided corresponding to the gear G14 for the process cartridge 515, the gears G27*a* through G27*d*, and the gear G34. It further has the pinion P arranged so that it can engage with the rack R provided on the process cartridge 515 when the rack R comes to a position $R_1$ as the process cartridge 515 is horizontal as described previously. With such an arrangement, the process cartridge 515 can be released from the slanting position (first position) to the second position in the way that the cartridge is turned together with the guide member 537 around a fulcrum 537A with a stepping motor (not shown) turning a certain angle, and the cartridge is further moved horizontally on the guide member 537 from that position to the second position as the rack R is engaged with pinion P. Such a movement is very effective for safe and easy handling of the process cartridge 515. It also is advantageous in that the toner cannot scatter or splash from the developing sections 523 of the process cartridge 515 even if the developing sections are separated from the toner hopper 535 to move as will be described in detail. In addition, the guide member 537 has microswitches MS1 and MS2 provided thereon which can detect positions of the process cartridge 515. The microswitches MS1 and MS2 respectively detect a first position at which image forming can be made when the gear G14, the gears G27*a* through G27*a*, and the gear G34 provided on the process cartridge 515 are engaged with the gear G13, the gears G26*a* through G26*d*, and the gear G33 provided on the apparatus body 510 and a second position which is separated from the transfer arrangement 524, or away from the first position, or slid in from the first position in a direction opposite to the insertion direction of the process cartridge 515. They feed the respective location signals to a control unit. It should be noted that the second position should be determined at which a center of gravity of the process cartridge 515 should be inside the apparatus body 510. The reason is that if the center of gravity is outside the apparatus body 510, the rack R is hard to engage with the pinion P, resulting in difficult removal and insertion of the process cartridge 515. The position detection sensors for detecting the first and second positions may not be limited to the microswitches, but can be replaced by any of the conventional sensors, such as photoelectric switches and magnetic switches. The microswitches MS1 and MS2 may not be provided on a 537, but can be mounted on the apparatus body 510 as they should detect the first and second positions.

First, if the process cartridge 515 is taken out, as shown in FIG. 1-a, the process cartridge 515 is turned around a fulcrum 537A from the first position to the horizontal position shown in FIGS. 1-a and 13-a. At the first position, the drive roller 518 and the transfer arrangement 524 keep a desirable distance (if the transfer member is a transfer drum, a proper pressure is given), and as the gear G14, the gears G27*a* through G27*a*, and the gear G34 provided on the process cartridge 515 are engaged with the drive gears, including the gear G13, the gears G26*a* through G26*d*, and the gear G33 provided on the apparatus body 510, respectively. If the process cartridge 515 is turned to the horizontal position, however, the drive gears on it are disengaged. Instead, the rack R is engaged with the pinion P.

If trouble of the transfer material occurs, an alarm lamp is automatically lit. At the same time, the operator should press a process cartridge take-out button on the operation panel 511 provided on the front of the apparatus body 510. A take-out signal the is input to the control unit. In order to take out the process cartridge 515 for preventive inspection, also the operator should press the take-out button. The same signal then is input to the control unit.

No print signal may be given by a print button on the operation panel 511. And, there may be given no image forming process signals, such as a photoreceptor belt drive signal, a fixing drive signal, a sheet discharge drive signal, and a sheet feed drive signal, which indicate no operations of image forming processes in a photoreceptor belt drive section, a fixing section, sheet discharge section, and sheet feed section, respectively. In those events, the control unit generates an open signal for the front exterior cover 514 to open. It also feeds a signal to the motor M2 and the electromagnetic clutch C22 which are drive devices for the moving arrangement for the process cartridge 515. In order to move the process cartridge 515 from the first position to the second position, first it is turned horizontal together with the guide member 537 around the fulcrum 37A once to engage the rack R with the pinion P. The pinion P is revolved to move the process cartridge 515 along the guide member 537 toward the second position (see FIG. 13-b). It should be noted that the process cartridge 515, as described previously, is moved not to damage surrounding devices and arrangements as guided by the precise path.

Alternatively, the opening of the front exterior cover 514 may be automatically made by a move start signal for the process cartridge 515.

When the process cartridge 515 moves as shown in FIG. 13-c, the cartridge 515 has moved to the second position, and feeds the signal to the control unit. When receiving the signal, the control unit releases the electromagnetic clutch C22 to stop the moving process cartridge 515 and at the same time, stops the motor M2.

That is, the process cartridge 515 is stopped at the second position with the rack R engaged with the pinion P, or has been slid from the first position to the second position. Therefore, large work space can be maintained for clearing jamming. In that state, the members can be widely separated one another to form an guide for manually taking out the opened front exterior cover 514 from the second position Thus, the process cartridge 515 can be safely and easily taken out of the apparatus body 510 by pulling it a little from the second position and largely moving it without any skill.

Conversely, to insert the process cartridge 515 into the apparatus body 510 after the replacement, the projection member 536 of the process cartridge 515 is to be inserted along with the guide member 537 in the process cartridge 515 to make the rack R engage with the pinion P as guided by an inside of the opened exterior cover 514 until the process cartridge 515 comes to the second position (see FIG. 13-c). The process cartridge 515 is further brought a little to a position at which the second microswitch MS2 is turned on: as shown in FIG. 13-b. These procedures are made in a short time very easily, safely and safely in a short time without distracting the operator's attention not in damaging surrounding devices.

In order to move the process cartridge 515 from that state to the first position where image forming can be made, the process cartridge 515 at the second position should be further inserted, or a set signal is input to the control unit by pressing the set button on the operation panel 511. With the set signal input, the control unit feeds a signal to the motor M2 and the electromagnetic clutch C22 to make the pinion P revolve in a direction opposite to that of the removal as a first step for horizontally moving the process cartridge 515 from the second position to the first position. The process cartridge 515 then is horizontally moved to approach the first position automatically in a very precise and safe way. (See FIG. 13-b).

When the process cartridge 515 moves, the microswitch MS1 detects that the process cartridge 515 has moved to the horizontal position near the first position as shown in FIG. 13-a, and feeds the signal to the control unit. When the control unit receives the signal, the process cartridge 515 is set at the normal first position at which it is slightly declined around a fulcrum 537A together with the guide member 537. Note that a stopper 537B is to correct the guide member 537 to the set position, and a stopper 537C is to make the guide member horizontal. They then release the electromagnetic clutch C22 and stop the motor M2. That is, the process cartridge 515 stops at the first position, and the gear G14, the gears G27*a* through G27*a*, and the gear G34 provided on the process cartridge 515 are engaged with the drive gears, including the gear G13, the gears G26*a* through G26*d*, and the gear G33 provided on the apparatus body 510, respectively, thereby allowing the image forming. At the same time, toner supply openings 538*a* through 538*d* of the developing sections 523*a* through 523*d* in the process cartridge 515 have end joints of corresponding toner feed tubes 853*a* through 853*d* of the toner hoppers 535*a* through 535*d* automatically connected therewith to allow supply of the toner.

In motion, the joints are automatically disconnected, and shutters are closed although not shown. It is however advantageous that openings on the developing sections will not drop the toner as the cartridge is positioned horizontal even when the openings are uncovered upward. After replacement of the process cartridge 515 or removal of jamming, therefore, the process cartridge 515 can be automatically put in only by a simple handling. This cannot only reduce the operator's work to a great extent, but also set the process cartridge 515 to the precise image forming position.

Figure 14A:
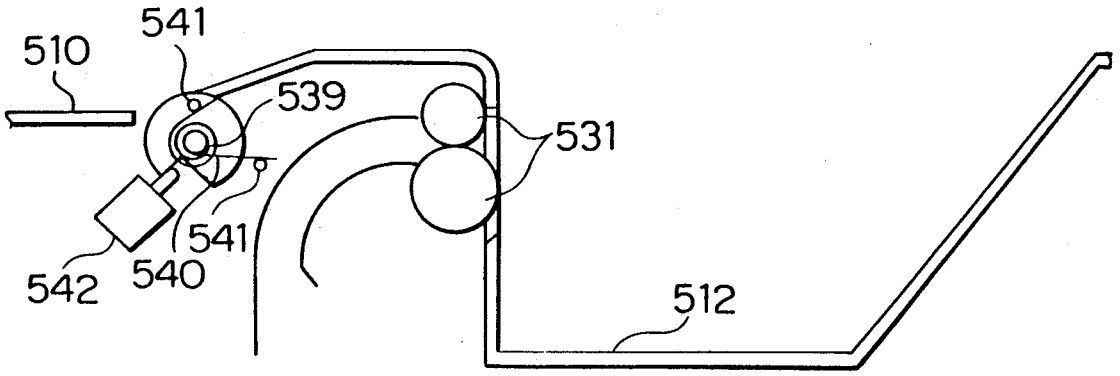
FIGS. 14-a and 14-b are views illustrating an upper cover releasing arrangement.
Figure 14B:
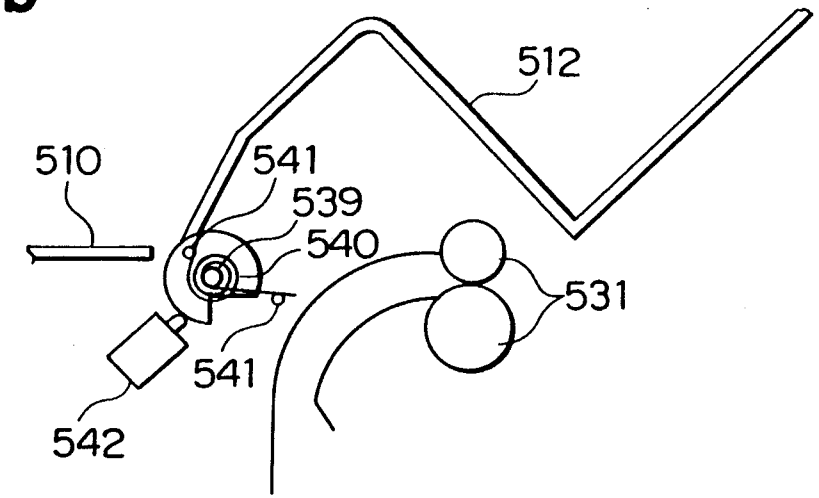

In turn, the following describes an upper cover releasing arrangement by reference to FIG. 14. The upper cover 512 is rotatably supported by a upper cover axis 539. It also is spring forced to open counterclockwise in the figure by a coil spring 540 wound around the upper cover axis 539 and two pins 541 one end of which is fixed at the apparatus body 510 and the other at the upper cover 512. A solenoid 542 is provided so that it can fasten the upper cover 512 when this is closed. When the upper cover 512 is closed during the image forming process, it also serves as discharge tray for the transferred material discharged by the sheet discharge roller 531 (see FIG. 14-a).

In clearing of jamming or the like, if the remove button on the operation panel provided on the front of the apparatus body 510 is pressed and if the image forming process signal is not output, then the control unit generates a move signal that allows the moving arrangement for the process cartridge 515 to move the process cartridge 515. It also generates an open signal to the solenoid 542 which is an upper cover opening device. When receiving the opening signal, the solenoid 542 retreats its spindle to unfasten the upper cover 512. The upper cover 512 then is forced open by spring (FIG. 14-b). Such an arrangement allows the operator to find and remove the jamming transfer material from the opening easily.

The upper cover releasing arrangement may not be limited to the one described in the embodiment, but can be replaced by a member which can be fastened to the upper cover axis 539 itself. Alternatively, there may be provided a gear on the upper cover axis 539 and a motor engaging the gear. The motor may be revolved by an open command from the operation panel 511 to release the upper cover 512. Conversely, the motor also can be reversely revolved by inputting a set signal from the operation panel 511 to the control unit to close the upper cover 512.

The front exterior cover 514 is opened or closed with the right same arrangement as the upper cover 512. Detailed description of it is omitted here.

Figure 15:
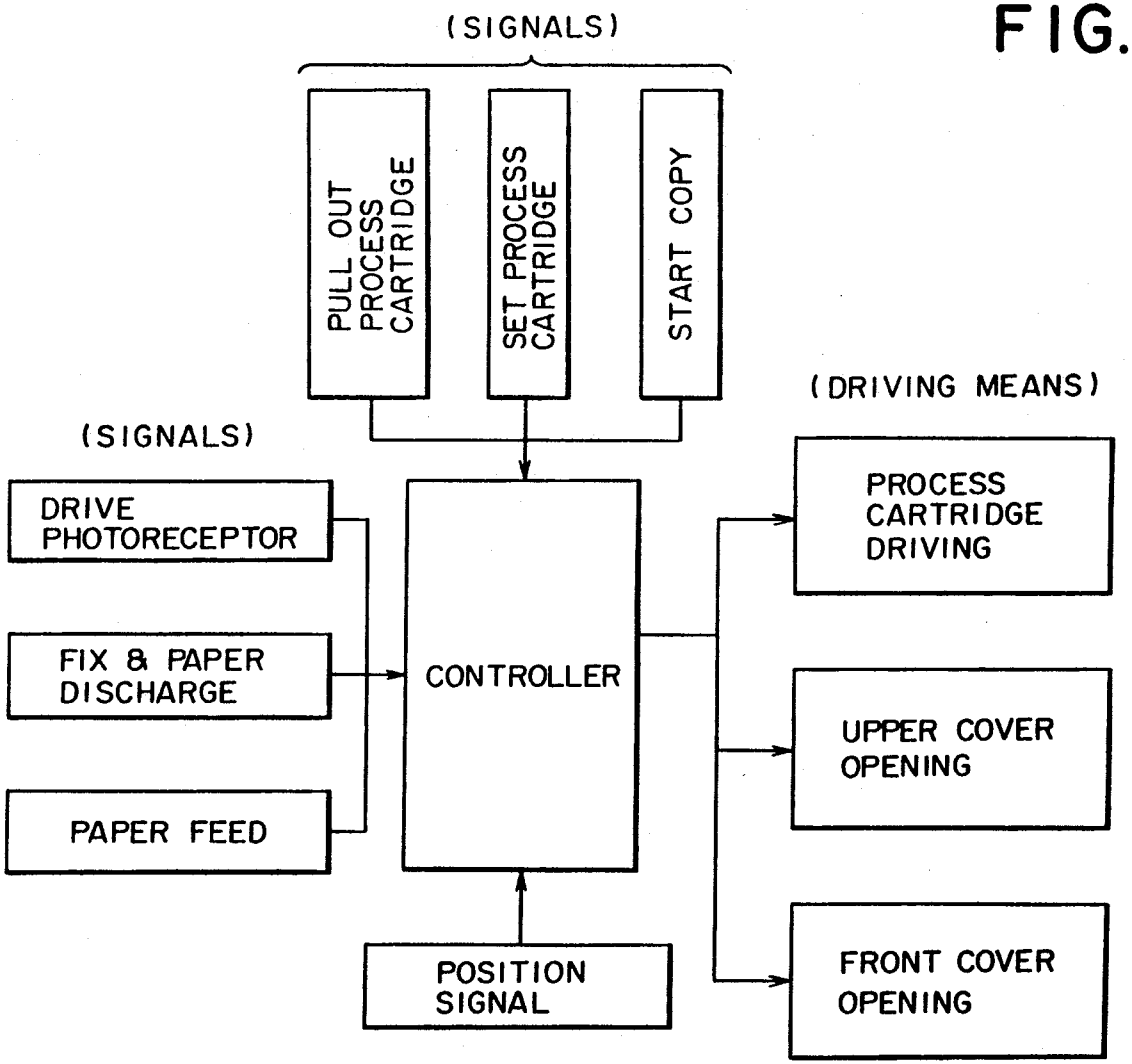
FIG. 15 is a control diagram.

The moving controls for the process cartridge 515 and the sheet feed cassette 516 and the releasing control for the upper cover 512 described so far are shown in FIG. 15. That is, the remove signal is input to the control unit and is indicated on the operation panel 511. The control unit feeds the move signal to the moving arrangement for the process cartridge 515 if no print signal is fed out of an operation section interlocked with the indication and if none of the photoreceptor belt drive signal, fixing and paper discharge drive signal, and paper feed drive signal is fed out of the photoreceptor belt drive section, the fixing and paper discharge section, and the paper feed section, respectively.

The process cartridge moving arrangement controls the drive system for the process cartridge moving arrangement to move the process cartridge 515 from the first position to the second position. If having a position detection signal for detecting that the process cartridge 515 has been moved to the second position, it stops the drive system for the process cartridge moving arrangement.

On the other hand, the control unit feeds the move signal to the moving arrangement for the process cartridge 515, and also feeds an open signal to the opening arrangement for the upper cover 512 and the opening arrangement for the front exterior cover 514 to open the upper cover 512 and the exterior cover 514. In other words, if a trouble is detected as jamming happens or the process cartridge 515 is replaced, the image forming operation stops. At the same time, its details are blinked on the operation panel 511 as message. This is interlocked with an operation that the front exterior cover 514 is opened to make the process cartridge 515 escape to the second position. The upper cover 512 also is opened. This allows the operator to see a situation of unit members at a jamming position from the upper side of the apparatus body 510 in detail. The operator can check and remove the jamming transfer material easily. If maintenance is needed in the end of service life of the photoreceptor belt or as necessary, its sign is indicated on the operation panel 511. For maintenance, checking, or replacement, the operator should draw the process cartridge 515 a little from the second position. The process cartridge 515 can be maintained or checked, or parts can be replaced, easily as it can be slid on a guide surface 514A inside the front exterior cover 514 to take out.

Opening of the front exterior cover 514, opening of the upper cover 512, and releasing of the process cartridge 515 may be made simultaneously if the release command is given when the process cartridge 515 is moved from the first position to the second position to release for removing jamming of the transfer material or for maintaining, checking, or replacing the process cartridge 515. Alternatively, releasing of the process cartridge may be started before the upper cover 512 and the exterior cover 514 are opened by detection of the start.

Further alternatively, the process cartridge 515 may partly serve as the front exterior for smart profile of the image forming apparatus. In this structure, however, the exterior cover cannot be made to serve as guide in removal of the process cartridge 515. Naturally, it is somewhat hard to remove it.

In addition, operating procedures can be made intuitively and easily as a toner supply sign, a waste toner full sign, and a no-paper sign are indicated on the operation panel 511. The waste toner collection box 526 positioned at the back of the process cartridge 515 is out of the apparatus body 510 when the process cartridge 515 is retreated at the second position. The waste toner collected in the box 526, therefore, can be easily removed together with the bag.

In the image forming process in the embodiment, the color toner image should be formed on the photoreceptor belt before it should be transferred to the transfer material one at a time. Alternatively, The toner image may be superimposed onto the transfer material on the transfer drum. This can be applied to a conventional monochrome printer operating in a monochrome process.

The present invention is not limited to the non-contact developing method in which description has bee made so far, but can be applied to any of the contact developing methods.

It is intended that all drive systems contained in the foregoing embodiment and in the drawings shall be interpreted as illustrative only not as limitative of the present invention. That is, it need hardly be said that they are not limited to any of combinations of gears, clutches, and belts.

Figure 17:
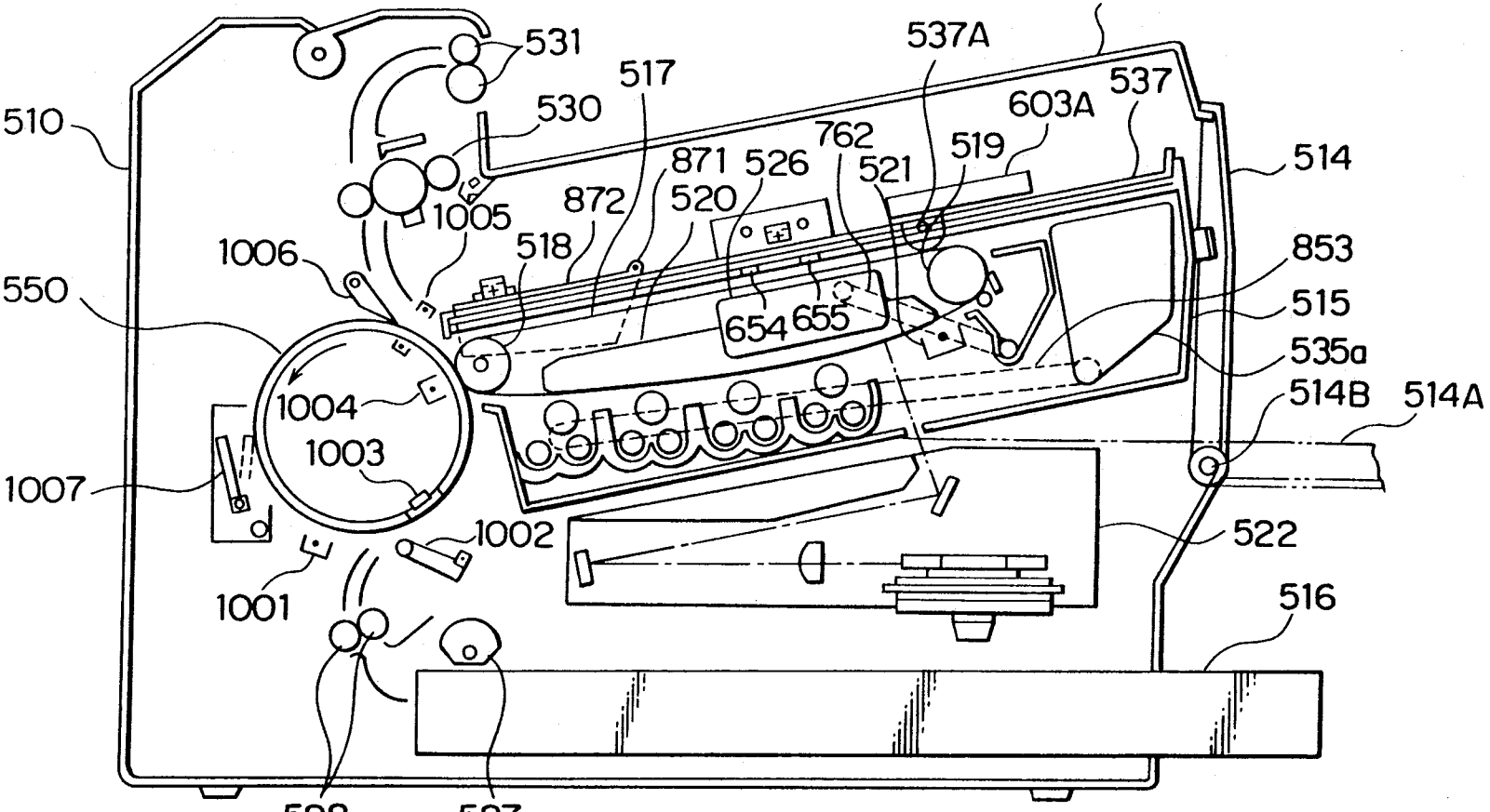
FIG. 17 is a left side view of major sections of an image forming apparatus of transfer drum type according to the present invention.

FIG. 17 is a left side view of major sections of an image forming apparatus of transfer drum type in another embodiment according to the present invention. A process cartridge 515 is the same as the one in the preceding embodiment except that a toner hopper 535*a* is integrated in the process cartridge 515.

In the image forming apparatus of transfer drum type, the photoreceptor belt 517 has a transfer drum 550 touched to its transfer section. The transfer drum 550 is revolved counterclockwise as synchronized with the photoreceptor belt 517. It has the transfer material wound around its surface. The wound transfer material has the color toner images formed on the photoreceptor belt 517 transferred on surface thereof one by one. The transfer material has all the color toner images registered thereon. It then is separated from the transfer drum 550, is fixed, and is discharged to the top of the apparatus body 510.

There are provided around the transfer drum 550 a charger 1001 which can suck the transfer material electrostatically and a winding member 1002 which can wind the transfer material mechanically. The winding member 1002 has a roller at its end which touches the transfer material only at the start when the transfer material is wound on the transfer drum 550. The transfer drum 550 also has a gripper 1003 on its surface which can retain an end of the transfer material carried synchronously.

A transfer arrangement 1004 transfers the toner image on the photoreceptor belt 517 to the transfer material electrostatically. A separation discharge electrode 1005 and a separation pawl 1006 separate the transferred material from the transfer drum 50. A detouchable cleaner 1007 removes the toner remaining on the transfer drum 50 having the transfer material removed.

The transfer material fed from the sheet feed cassette 516 is made to come to the transfer drum 50 charged by the charger 1001 as synchronized. It was wound on the transfer drum 50 by the winding member 1002. Its lead is held by the gripper 1003. The transfer arrangement 1004 transfers the yellow toner image formed on the photoreceptor belt 517 to the transfer material. The transfer drum 50 having completed the first transference continues revolution is cleaned by the cleaner 1007, and similarly transfers the succeeding color toner images to the transference material to superimpose, including the magenta toner images at the second turn, the cyan toner image at the third turn, and the black toner image at the fourth turn. When the four color toner images are completely transferred, the transfer material is discharged by the separation discharge electrode 1005. It is released from holding at its lead by the separation pawl 1006, and is carried to the fixing roller 530.

The image forming apparatus in this embodiment is constructed so that the transfer drum 50 is not contained in the movable process cartridge 515 in the apparatus body 510. The process cartridge 515, therefore, can be moved similarly as in the preceding embodiment.

If the process cartridge 515 is moved from the first load position to the second load position, the upper cover 512 is opened, wide space is released around the transfer arrangement 524, the sheet feed route 529, and the fixing arrangement 530. This causes optical fatigue to the exposed portion of the photoreceptor belt although troubleshooting can be made easily. A photoreceptor cover 872, therefore, is provided at an end along the guide member 537 for the process cartridge 515 in the apparatus body 510 so that it can turn around a fulcrum 871 fixed on the main body. The cover is forced by a torque spring to always turn counterclockwise. If the process cartridge 515 is at the first load position, the cover is pressed up by an end of the cartridge. The photoreceptor belt, as shown in FIGS. 1 and 17, is opened as faced with the transfer arrangement 524 or the transfer drum 550.

Figure 16:
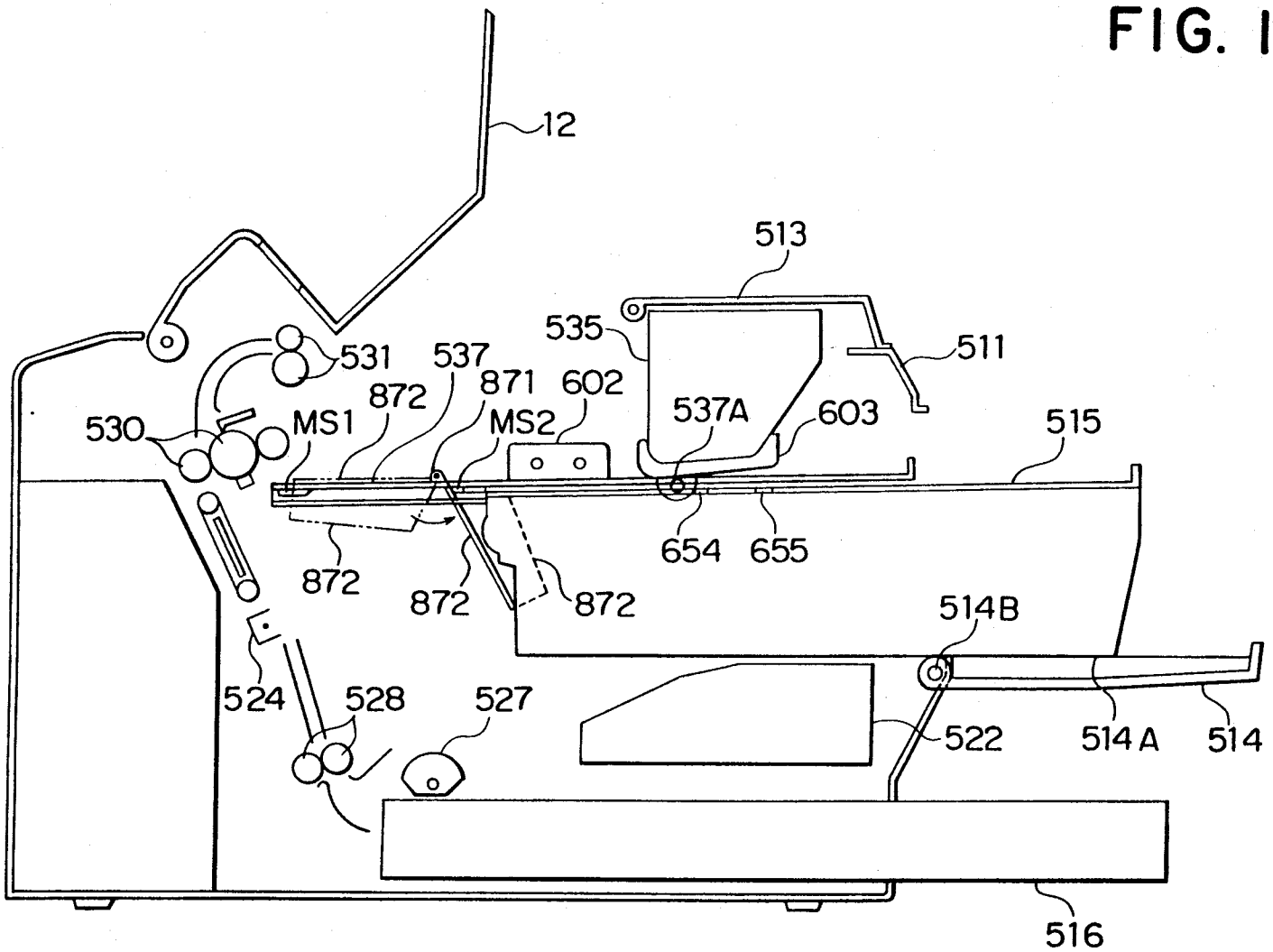
FIG. 16 is a left side view for the color printer when the process cartridge is at a second position.

However, as shown in FIG. 16, if the process cartridge 515 retreats to the second load position, the photoreceptor exposure portion at the end of the process cartridge 515 is made optically tight as enclosed by the photoreceptor cover 872.

On the other hand, an action member block 602 having a discharge arrangement including a discharge lamp or a discharge electrode or an exposure arrangement provided thereon has windows 654 and 655 at positions facing the process cartridge 515 when this is at the first load position. This allows the photoreceptor belt 517 to be discharged after the transference to the transfer material is completed.

However, when the upper cover 512 is opened when the process cartridge 515 retreats to the second position, external light enters the windows 654 and 655, resulting in the optical fatigue on the photoreceptor. To prevent this, when the process cartridge 515 retreats to the second position, the windows 654 and 655 are made to enter the back of a base 603 for the toner hopper 535 provided on the apparatus body 510 or a special shield plate 603A shown in FIG. 17 to conceal, thereby keeping the optical tightness.

As described in detail so far, the advantages of the image forming apparatus of the present invention as described above consist in particular in the fact that with the detection signals, including the trouble occurrence signal, the service life signal, or the waste toner full signal, the process cartridge can be interlocked to slide away from the position where image forming can be made and at the same time, the upper cover and front exterior cover can be also made to open, thereby allowing easy and secure trouble shooting.

As a result of the automatic movement of the process cartridge with the upper cover made open in the image forming apparatus of the present invention, the operator can replace the process cartridge easily and lightly without any confusion. Also, as the process cartridge can be slid away from the second position for clearing of jamming, the operator can see the jamming position at a glance through an opening of the upper cover. Further, wide working area can be made enough to increase workability for clearing of jamming to a great extent. Further more, if removing the jamming paper, he or she cannot only scratch the image carrier, but also is free of directly touching it by hand. More over, as the process cartridge can be mechanically moved horizontally, can be removed from the second position, and can be guided along the opened exterior cover to load to the second position, it can be replaced or made to clear of jamming without being subjected to extra vibration for virtually no splash of the developing agent. This is preferable to increase maintainability.

If the image forming apparatus of the present invention is used as color printer, the operator can perform at the front all manipulations, such as removal and insertion of the process cartridge and the sheet feed cassette, clearance of jamming, and toner supply. It, therefore, provides similar operationability and maintainability to those of the one-directional manipulation of a monochrome printer.

What is claimed is:

1. An image forming apparatus comprising:

a main body including a sheet passage for conveying a copy sheet;

a process-cartridge detachably provided in said main body, said process-cartridge including therein at least an image carrying body for carrying a toner image, said process-cartridge being adapted to be locked at a first position where said process-cartridge adjoins said sheet passage such that said process-cartridge and said sheet passage cooperatively form a transfer section where a toner image is transferred from said image carrying body to said copy sheet;

said process-cartridge further being adapted to be released from said first position to a second position where said process-cartridge is spaced a distance apart from said sheet passage such that a space that is suitable for clearing a copy sheet jam is provided between said process-cartridge and said sheet passage;

jam detection means for detecting said copy sheet jam in said sheet passage;

cartridge driving means for driving the process-cartridge; and control means for controlling the cartridge driving means to automatically drive the process-cartridge from the first position to the second position when said jam detecting means detects a copy sheet jam during a conveyance of said copy sheet.

2. The image forming apparatus of claim 1, further comprising:

an opening portion of the image forming apparatus;

a cover adapted to open and close said opening portion;

cover driving means for driving the cover to open and close the opening portion of the image forming apparatus; and wherein said control means further controls said cover driving means to drive said cover to open said opening portion when said image forming apparatus requires a maintenance procedure, when a new supply of toner is required or when said copy sheet jam occurs in conveyance of the copy sheet.

3. The image forming apparatus of claim 1, wherein said control means controls said driving means further to move said process-cartridge from said second position to said first position upon clearing of the jam.

4. The image forming apparatus of claim 1, further comprising:

an operator panel having a display and a command key, said operator panel displaying maintenance information and jam information on said display, said control means in response to a manual operation of said command key controlling said driving means to drive said process-cartridge from said first position to said second position.

5. The image forming apparatus of claim 1, having a main frame for supporting said main body, wherein:

said process-cartridge is slidably provided to a main frame of said image forming apparatus; and said cartridge driving means drives said process-cartridge to slide along said frame in a release direction from said first position to said second position, said release direction being fixed relative to a horizontal direction or an upwardly inclined direction.

6. The image forming apparatus of claim 1, further comprising:

guide rail means rotatably provided on a main frame of said image forming apparatus for slidably supporting said process-cartridge, said guide rail means being rotatable between an inclined position and a horizontal position;

rail driving means for rotating said guide rail from said inclined position to said horizontal position; and wherein said control means controls said rail driving means to rotate said guide rail from said inclined position to said horizontal position before the release of said cartridge to said second position.

7. The apparatus of claim 1, wherein said second position is a position suitable for pulling said process cartridge out of said main body.

8. The apparatus of claim 7, further comprising:

maintenance detection means for detecting a remaining life expectancy of a plurality of components in said process-cartridge; and wherein:

said control means controls the cartridge driving means to automatically drive the process-cartridge from the first position to the second position when said maintenance detection means detects a need to carry out a maintenance procedure for at least one of said plurality of components in said process-cartridge.

9. The apparatus of claim 7, wherein:

said process-cartridge comprises a toner container and a toner detection means for detecting a need to perform a maintenance procedure for said toner container; and said control means controls the cartridge driving means to automatically drive the process-cartridge from the first position to the second position when said toner detection means detects said need to perform said maintenance procedure for said toner container in said process cartridge.

10. An image forming apparatus comprising:

a process-cartridge having an opening portion, said process-cartridge being detachably provided in a main body of the image forming apparatus, said process-cartridge including therein at least an image carrying body, and said process-cartridge being adapted to be locked at a first position suitable for image forming and adapted to be released to a second position suitable for pulling the process-cartridge out of the main body;

cartridge driving means for driving the process-cartridge;

control means for controlling the cartridge driving means to drive the process-cartridge from the first position to the second position when the image forming apparatus requires a maintenance procedure, or when a new supply of toner is required or when a jam occurs in conveyance of a copy sheet;

a cover adapted to open and close said opening portion of said process-cartridge;

cover driving means for driving the cover to open and close said opening portion of said process-cartridge; and wherein said control means further controls said cover driving means to drive said cover to open said opening portion when said image forming apparatus requires a maintenance procedure, or when a new supply of toner is required or when a jam occurs in conveyance of the copy sheet.

11. The image forming apparatus of claim 10, wherein said control means controls said driving means further to move said process-cartridge from said second position to said first position upon clearing of a jam.

12. The image forming apparatus of claim 10, further comprising:

an operator panel having a display and a command key, said operator panel displaying maintenance information and jam information on said display, and said control means, in response to a manual operation of said command key, controlling said driving means to drive said process-cartridge from said first position to said second position.

13. The image forming apparatus of claim 10, having a main frame for supporting said main body, wherein:

said process-cartridge is slidably provided to said main frame of said image forming apparatus; and said cartridge driving means drives said process-cartridge to slide along said main frame in a release direction from said first position to said second position, said release direction being fixed relative to a horizontal direction or an upwardly inclined direction.

14. The image forming apparatus of claim 10, further comprising:

guide rail means rotatably provided on a main frame of said image forming apparatus for slidably supporting said process-cartridge, said guide rail means being rotatable between an inclined position and a horizontal position;

rail driving means for rotating said guide rail means from said inclined position to said horizontal position; and wherein said control means controls said rail driving means to rotate said guide rail means from said inclined position to said horizontal position before a release of said process-cartridge to said second position.

15. An image forming apparatus, comprising:

a process-cartridge detachably provided in a main body of the image forming apparatus, said process-cartridge including therein at least an image carrying body, and said process-cartridge being adapted to be locked at a first position suitable for image forming and adapted to be released to a second position suitable for pulling the process-cartridge out of the main body;

cartridge driving means for driving the process-cartridge;

control means for controlling the cartridge driving means to drive the process-cartridge from the first position to the second position when the image forming apparatus requires a maintenance procedure, or when a new supply of toner is required or when a jam occurs in conveyance of a copy sheet; and an operator panel having a display and a command key, said operator panel displaying maintenance information and jam information on said display, and said control means, in response to a manual operation of said command key, controlling said driving means to drive said process-cartridge from said first position to said second position.

16. The image forming apparatus of claim 15, wherein:

said control means further controls said cartridge driving means to move said process-cartridge from said second position to said first position upon clearing of a jam.

17. The image forming apparatus of claim 15, having a main frame for supporting said main body, wherein:

said process-cartridge is slidably provided to said main frame of said image forming apparatus; and said cartridge driving means drives said process-cartridge to slide along said main frame in a release direction from said first position to said second position, said release direction being fixed relative to a horizontal direction or an upwardly inclined direction.

18. The image forming apparatus of claim 15, further comprising:

guide rail means rotatably provided on a main frame of said image forming apparatus for slidably supporting said process-cartridge, said guide rail means being rotatable between an inclined position and a horizontal position;

rail driving means for rotating said guide rail means from said inclined position to said horizontal position; and wherein said control means control said rail driving means to rotate said guide rail means from said inclined position to said horizontal position before a release of said process-cartridge to said second position.

* * * * *